US007239224B2

(12) United States Patent
Wada

(10) Patent No.: US 7,239,224 B2
(45) Date of Patent: Jul. 3, 2007

(54) IGNITION COIL HAVING CENTER CORE

(75) Inventor: Jyunichi Wada, Chita-gun (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/389,161

(22) Filed: Mar. 27, 2006

(65) Prior Publication Data

US 2006/0214758 A1 Sep. 28, 2006

(30) Foreign Application Priority Data

Mar. 28, 2005 (JP) ..... 2005-092357
Mar. 28, 2005 (JP) ..... 2005-092358
Mar. 28, 2005 (JP) ..... 2005-092359
Feb. 10, 2006 (JP) ..... 2006-033277

(51) Int. Cl.
*H01F 27/02* (2006.01)

(52) U.S. Cl. ..... 336/90; 339/198

(58) Field of Classification Search ..... 336/83, 336/90–96, 192, 198; 123/634–635
See application file for complete search history.

(56) References Cited

U.S. PATENT DOCUMENTS 4,893,105 A * 1/1990 Maeda et al. ..... 336/84 M
2002/0057181 A1* 5/2002 Sato et al. ..... 336/221

FOREIGN PATENT DOCUMENTS

| | | |
|---|---|---|
| JP | 03-238805 | * 10/1991 |
| JP | 8-167518 | 6/1996 |
| JP | 10-041152 | 2/1998 |
| JP | 11-087157 | 3/1999 |

* cited by examiner

*Primary Examiner*—Tuyen T. Nguyen
(74) *Attorney, Agent, or Firm*—Nixon & Vanderhye PC

(57) ABSTRACT

An ignition coil includes a primary coil, a secondary coil, a spool, and a center core. The primary coil and the secondary coil are arranged substantially coaxially with each other. The secondary coil is on an inner side of the primary coil. The secondary coil is wound around the spool. The center core is inside of the spool. The spool has a tapered inner surface, which is axially defined at least partially in the spool. The tapered inner surface has the diameter that increases as being distant from a high voltage tip end of the secondary coil on the high voltage side of the secondary coil. The center core has a tapered outer surface, which is axially defined at least partially in the center core. The tapered outer surface has the diameter that increases as being distant from the high voltage tip end of the secondary coil.

31 Claims, 30 Drawing Sheets

IGNITION COIL HAVING CENTER CORE

CROSS REFERENCE TO RELATED APPLICATIONS

This application is based on and incorporates herein by reference Japanese Patent Applications No. 2005-92357 filed on Mar. 28, 2005, No. 2005-92358 filed on Mar. 28, 2005, No. 2005-92359 filed on Mar. 28, 2005, and No. 2006-033277 filed on Feb. 10, 2006.

FIELD OF THE INVENTION

The present invention relates to an ignition coil for energizing a spark plug.

BACKGROUND OF THE INVENTION

An ignition coil 91 shown in FIG. 36 is used for energizing a spark plug, thereby generating spark in the spark plug. The ignition coil 91 is received in a plughole of an internal combustion engine of a vehicle, or the like. The ignition coil 91 includes a cylindrical portion 92 that accommodates a primary coil 921, a secondary coil 922, and a center core 94, which are coaxially arranged. The cylindrical portion 92 has a tip end 901, in which a plug holder 971 is formed. The cylindrical portion 92 has a rear end 902, to which an igniter 972 is provided for supplying electricity to the primary coil 921. As shown in FIG. 37, the secondary coil 922 is wound around a secondary spool 93, which is formed of resin to be in a cylindrical shape. The secondary spool 93 has a tapered inner surface 931, which is formed as a matter of convenience in a forming process of the secondary spool 93. The tapered inner surface 931 has the inner diameter that increases as being distant from the tip end 930 of the secondary spool 93. The center core 94 is arranged inside of the secondary spool 93. The center core 94 is constructed of multiple silicon steel plates, which are stacked in the radial direction of the center core 94. The center core 94 has the outer diameter that is axially constant. The outer diameter of the center core 94 corresponds to the inner diameter smallest of the secondary spool 93. The center core 94 and the secondary spool 93 defines a gap therebetween. This gap becomes large, as being distant from the tip end 930 of the secondary spool 93.

The igniter 972 inputs an ignition timing signal from an electronic control unit (ECU) of the engine, so that the igniter 972 supplies electricity to the primary coil 921. Thus, the primary coil 921 generates magnetic flux passing through the center core 94, thereby causing an interlinkage with respect to the secondary coil 922. The secondary coil 922 generates induced electromotive force by electromagnetic induction, thereby generating spark in the sparkplug mounted to the plug holder 971. Magnetic flux generated using the primary coil 921 passes through the center core 94, thereby being enhanced.

According to JP-A-10-41152, the outer diameter of the center core is increased for enhancing induced electromotive force generated in the secondary coil. Conventionally, when the outer diameter of the center core is increased, the ignition coil is jumboized. Consequently, the inner diameter of the plughole of the engine needs to be increased. However, it is difficult to increase the outer diameter of the plughole, in a downsized engine.

In addition, according to JP-A-8-167518, a center core having an enhanced magnetic property is disclosed. However, it is still demanded to produce a center core, which is capable of producing high power, and to restrict manufacturing cost of the center core from increasing.

In recent years, a high power ignition coil having a downsized structure is demanded. An ignition coil has a center core and an outer core, which are separated from each other. In this structure, the ignition coil has an open magnetic circuit, in which magnetic efficiency may decrease due to leakage of magnetic flux. Particularly, when the center core and the outer core interpose an air space therebetween, leakage of magnetic flux in the air space becomes large, because of a large magnetic resistance in the air space. According to JP-A-11-87157, an ignition coil has a structure, in which magnetic flux is restricted from leaking. However, even in this structure, it is difficult to restrict magnetic flux from leaking.

SUMMARY OF THE INVENTION

In view of the foregoing and other problems, it is an object of the present invention to produce an ignition coil, which is capable of enhancing performance without excessively being jumboized. It is another object of the present invention to produce a relatively low cost ignition coil, which is capable of producing high power. It is another object of the present invention to produce an ignition coil, which is capable of reducing leakage of magnetic flux therein.

According to one aspect of the present invention, an ignition coil includes a primary coil, a secondary coil, a spool, and a center core. The secondary coil is arranged substantially coaxially with respect to the primary coil. The spool has a substantially cylindrical shape. One of the primary coil and the secondary coil is an inner coil arranged on an inner side of an other of the primary coil and the secondary coil. The inner coil is wound around the spool. The center core is located on an inner side of the spool. The spool has a tapered inner surface, which is defined at least partially in the spool with respect to an axial direction of the spool. The tapered inner surface has a diameter that increases as being distant from a high voltage tip end of the secondary coil. The high voltage tip end of the secondary coil is on a high voltage side of the secondary coil. The center core has a tapered outer surface, which is defined at least partially in the center core with respect to an axial direction of the center core. The tapered outer surface has a diameter that increases as being distant from the high voltage tip end of the secondary coil. The tapered inner surface of the spool is opposed to the tapered outer surface of the center core with respect to a substantially radial direction of the center core.

Alternatively, an ignition coil is adapted to connecting with a sparkplug. The ignition coil includes a cylindrical portion and a plug holder. The cylindrical portion includes a primary coil, a secondary coil, and a center core. The primary coil and the secondary coil are substantially coaxial with respect to each other. The plug holder is provided to a tip end of the cylindrical portion. The plug holder is adapted to connecting with the sparkplug. The center core includes a first end portion, a second end portion, and a center portion. The first end portion is located on a side of one end of the center core with respect to an axial direction of the center core. The second end portion is located on a side of an other end of the center core with respect to the axial direction of the center core. The first end portion occupies 15% or greater in length of the center core. The second end portion occupies 15% or greater in length of the center core. The center portion is located between the first end portion and the second end portion. The first end portion and the second end portion of the center core are formed of a first soft magnetic material. The center portion of the center core is at least partially formed of a second soft magnetic material. The second soft magnetic material has a saturation magnetic flux density, which is higher than a saturation magnetic flux density of the first soft magnetic material.

Alternatively, an ignition coil is adapted to be connecting with a sparkplug. The ignition coil includes a cylindrical portion and a plug holder. The cylindrical portion includes a primary coil, a secondary coil, a center core, and an outer core. The primary coil is substantially coaxial with respect to the secondary coil. The center core is arranged on an inner circumferential side of the secondary coil. The outer core is arranged on an outer circumferential side of the primary coil. The plug holder is provided to a tip end of the cylindrical portion, the plug holder being adapted to connecting with the sparkplug. The cylindrical portion includes a rear end portion. The center core has a rear end, which at least partially protrude to a rear side axially beyond the outer core in a non-lapping region of the rear end portion of the cylindrical portion. The ignition coil further includes a side plate that at least partially covers the non-lapping region from an outer circumferential side. The side plate is formed of a soft magnetic material.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
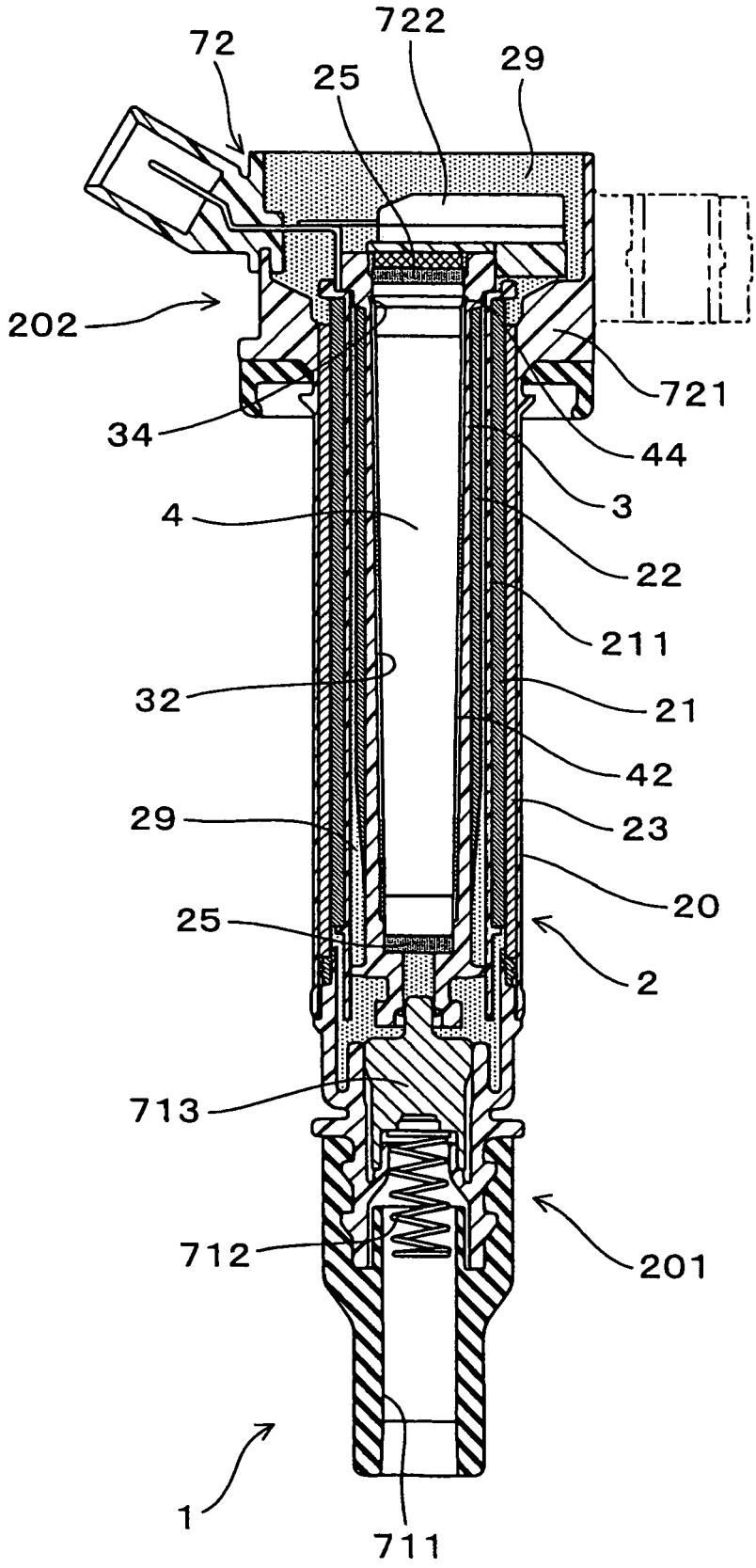
FIG. 1 is a partially cross sectional side view showing an ignition coil, according to a first embodiment of the present invention.
Figure 2:
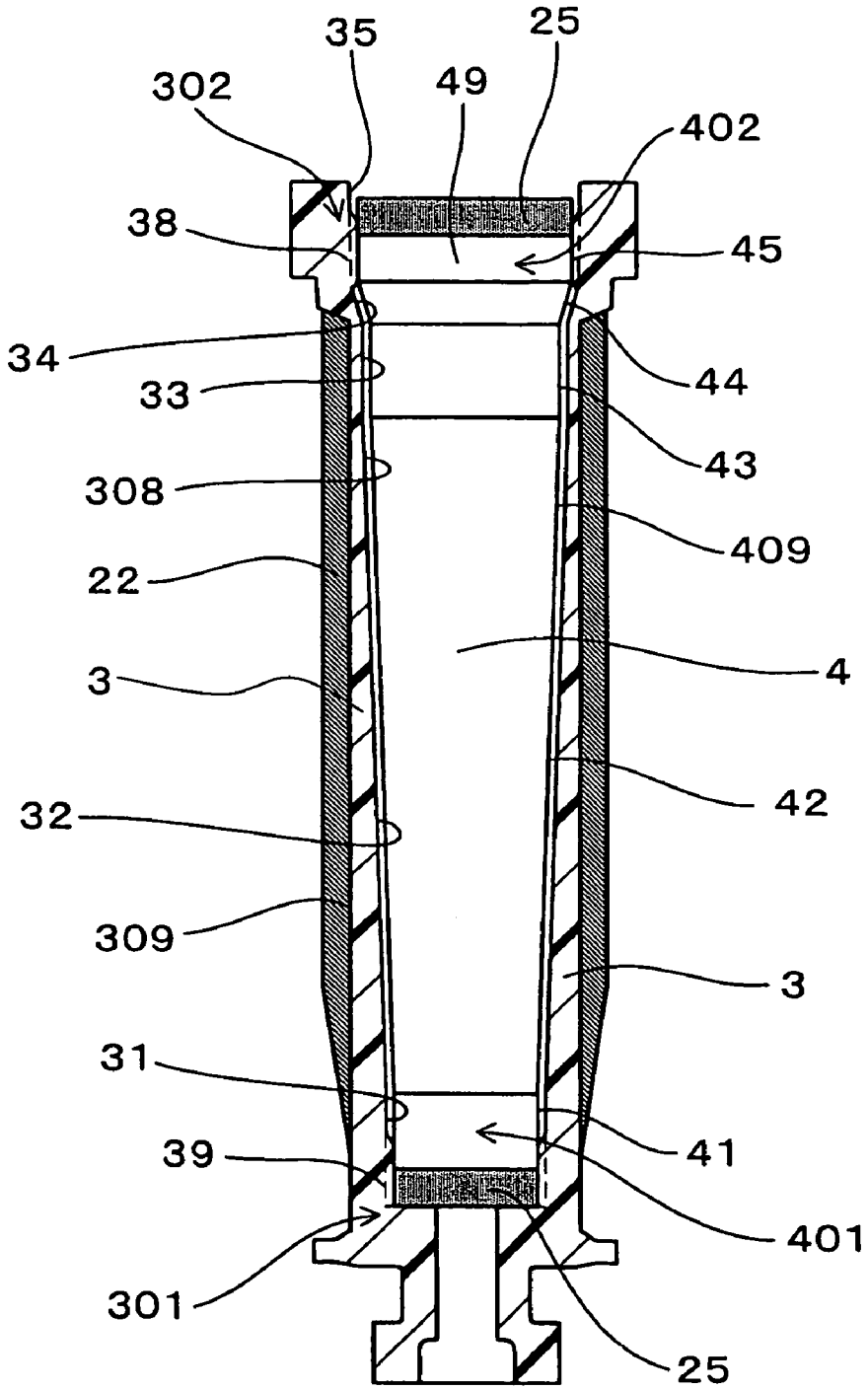
FIG. 2 is a partially cross sectional side view showing a secondary spool and a center core of the ignition coil, according to the first embodiment.

As shown in FIGS. 1, 2, an ignition coil 1 includes a cylindrical portion 2 that accommodates a primary coil 21, a secondary coil 22, and a center core 4, which are substantially coaxially arranged. The cylindrical portion 2 has a tip end 201, on which a plug holder 711 is formed. The ignition coil 1 is a stick type coil, for example. The cylindrical portion 2 and the plug holder 711 of the ignition coil 1 are arranged in a plughole of an internal combustion engine. The secondary coil 22 has a winding end on a high voltage side thereof. In this example embodiment, the winding end on the high voltage side is arranged on the side of the tip end of the cylindrical portion 2 in the ignition coil 1. Here, the tip end or the side of the tip end represents the tip end on the high voltage side or the high voltage side. The rear end or the side of the rear end represents the end on the low voltage side or the low voltage side.

Referring to FIG. 2, in this example embodiment, the secondary coil 22 is an inner coil, which is arranged on the inner side with respect to the primary coil 21. The secondary coil 22 is wound around a secondary spool 3. The center core 4 is arranged inside of the secondary spool 3. The secondary spool 3 has first and second tapered inner surfaces 32, 34 partially with respect to the axial direction of the secondary spool 3. Each of the first and second tapered inner surfaces 32, 34 has the inner diameter, which increases as being distant from the tip end 201 of the cylindrical portion 2 (FIG. 1). The center core 4 has tapered outer surfaces 42, 44 partially with respect to the axial direction of the center core 4. Each of the tapered outer surfaces 42, 44 respectively has the outer diameter, which increases as being distant from the tip end 201 of the cylindrical portion 2 (FIG. 1).

The first and second tapered inner surfaces 32, 34 respectively radially oppose the tapered outer surfaces 42, 44.

Referring to FIG. 1, in this example embodiment, the cylindrical portion 2 of the ignition coil 1 is constructed of a resinous coil case 20, into which an outer core 23, the primary coil 21, the secondary coil 22, and the center core 4 are inserted. The primary coil 21 is constructed of an electrically insulative wire, which is wound around the outer circumferential surface of a primary spool 211. The primary spool 211 is formed of resin to be in a substantially cylindrical shape. The secondary coil 22 is constructed of an electrically insulative wire, which is wound around the outer circumferential surface of the secondary spool 3. The secondary spool 3 is formed of resin to be in a substantially cylindrical shape. The wire of the secondary coil 22 is wound for a winding number, which is greater than a winding number of the primary coil 21. Alternatively, the primary coil 21 may be formed by winding an electrically insulative wire to be in a substantially cylindrical shape, and joining the wire using a fusion material or the like.

The primary coil 21 is inserted into the outer core 23, which is formed of metal to be in a substantially cylindrical shape. The outer core 23 is inserted into the coil case 20. The secondary coil 22 is inserted into the inside of the inner circumferential surface of the primary coil 21. The center core 4 is arranged inside of the inner circumferential side of the secondary core 22. The center core 4 is formed of a dust core, for example. The center core 4 has both axial ends, to which permanent magnets 25 are respectively provided. Each of the permanent magnets 25 has the outer diameter, which is substantially the same as the outer diameter of the corresponding end of the center core 4. The primary coil 21 is supplied with electricity, so that the primary coil 21 generates magnetic flux. The magnetic flux passes through a magnetic circuit, which is constructed of the center core 4, the outer core 23, and the permanent magnet 25, thereby being enhanced.

An electrically insulative resin 29 is filled in all the gap between the center core 4 and the secondary coil 22, the gap between the secondary coil 22 and the primary coil 21, and the gap between the primary coil 21 and the outer core 23. The electrically insulative resin 29 is epoxy resin in this example embodiment.

As follows, the secondary spool 3 and the center core 4 are described in reference to FIG. 2.

The secondary spool 3 has the first and second tapered inner surfaces 32, 34. Each of the first and second tapered inner surfaces 32, 34 has the diameter that increases as being distant from the tip end 201 (FIG. 1) of the cylindrical portion 2, i.e., as being distant from the tip end 301 of the secondary spool 3. The secondary spool 3 further has first, second, and third straight inner surfaces 31, 33, 35. Each of the first, second, and third straight inner surfaces 31, 33, 35 has the inner diameter, which is substantially constant with respect to the axial direction thereof. The first straight inner surface 31, the first tapered inner surface 32, the second straight inner surface 33, the second tapered inner surface 34, and the third straight inner surface 35 are arranged in this order from the side of the tip end 301 of the secondary spool 3.

The secondary spool 3 has a rear end 302 having a first contact inner surface 38. The center core 4 has a large diameter portion 49 that makes contact with the first contact inner surface 38, so that the center axis of the center core 4 can be adjusted. The tip end 301 of the secondary spool 3 has a second contact inner surface 39. The center core 4 has a tip end 401 having a first straight outer surface 41. The second contact inner surface 39 of the secondary spool 3 makes contact with the first straight outer surface 41 of the center core 4, so that the center axis of the center core 4 can be adjusted.

The first and second contact inner surfaces 38, 39 are respectively formed as protrusions 38, 39, which respectively protrude from the inner circumferential surface of the secondary spool 3. The protrusions 38, 39 are formed in multiple locations along the circumferential direction of an inner circumferential surface 308 of the secondary spool 3. The large diameter portion 49 and the tip end 401 of the center core 4 respectively make contact with the protrusions 38, 39, so that the center axis of the center core 4 can be readily adjusted with respect to the center axis of the secondary spool 3.

The protrusions 38, 39 serve as a first contact inner surface 38 and a second contact inner surface 39. The first and second contact inner surfaces 38, 39 may be formed entirely in the inner circumferential surface 308. The secondary coil 22 is constructed of the electrically insulative wire wound for the winding number greater than that of the primary coil 21. The secondary coil 22 is arranged on an outer circumferential surface 309 of the secondary spool 3.

The center core 4 has the first and second tapered outer surfaces 42, 44. Each of the first and second tapered outer surfaces 42, 44 has the diameter that increases as being distant from the tip end 201 (FIG. 1) of the cylindrical portion 2, i.e., as being distant from the tip end 401 of the center core 4. The center core 4 further has first, second, and third straight outer surfaces 41, 43, 45. Each of the first, second, and third straight outer surfaces 41, 43, 45 has the outer diameter, which is substantially constant with respect to the axial direction thereof. The first straight outer surface 41, the first tapered outer surface 42, the second straight outer surface 43, the second tapered outer surface 44, and the third straight outer surface 45 are arranged in this order from the side of the tip end 401 of the center core 4.

The center core 4 has a rear end 402, which has the large diameter portion 49 having the diameter largest of the center core 4. In this example embodiment, the third straight outer surface 45 defines the large diameter portion 49. The large diameter portion 49 is arranged on the side of the rear end with respect to a winding region, in which the secondary coil 22 is wound around the secondary spool 3. The center core 4 has the axial ends, to which the permanent magnets 25 are provided. Each of the axial ends of the center core 4 and corresponding one of the permanent magnets 25 have substantially the same diameter. The permanent magnets 25 are arranged such that each of the permanent magnets 25 generates magnetic flux in a direction opposite to the direction of magnetic flux generated using the primary coil 21. The center core 4 is formed of dust core, which is shaped by compressing powder of a soft magnetic material, for example, for example. Specifically, the center core 4 can be formed by filling powder of a soft magnetic material into a die, and hot pressing the powder, for example. The soft magnetic material may be composed mainly of iron. The shape of the outer surface of the dust core can be freely defined by the surface of the die. Therefore, it is advantageous to form the center core 4 of a dust core, when the shape of the outer circumferential surface is complicated in the structure of the center core 4.

Referring to FIG. 2, the center core 4 is arranged on the side of the inner circumferential surface of the secondary spool 3. The center core 4 has an outer circumferential surface 409, which is defined substantially along the inner circumferential surface 308 of the secondary spool 3. That is, the inner circumferential surfaces of the secondary spool 3 and the outer circumferential surfaces of the center core 4 substantially oppose each other. Specifically, the first straight inner surface 31 and the first straight outer surface 41, and the first tapered inner surface 32 and the first tapered outer surface 42 substantially oppose each other. The second straight inner surface 33 and the second straight outer surface 43, the second tapered inner surface 34 and the second tapered outer surface 44, and the third straight inner surface 35 and the third straight outer surface 45 substantially oppose each other.

The large diameter portion 49 of the center core 4 makes contact with the first contact inner surface 38 of the secondary spool 3 via the third straight outer surface 45. In addition, the first straight outer surface 41 makes contact with the second contact inner surface 39 of the secondary spool 3. In this structure, the center axis of the center core 4 can be adjusted.

Referring to FIG. 1, the tip end 201 of the cylindrical portion 2 has the plug holder 711, to which a spark plug is to be attached. The plug holder 711 has a coil spring 712, which makes contact with the spark plug. The coil spring 712 is electrically connected with an end of the winding of the secondary coil 22 on the high voltage side via a high voltage terminal 713.

The cylindrical portion 2 has the rear end 202 having an igniter portion 72. The igniter portion 72 has an igniter case 721, which accommodates an igniter 722 for supplying electric power to the primary coil 21. The igniter 722 is embedded in an electrically insulative resin 29 in a condition where the igniter 722 is arranged in the igniter case 721. The igniter 722 includes an electric power control circuit, an ion electricity detecting circuit, and the like. The electric power control circuit includes a switching element, which is operated by a signal transmitted from the ECU, and the like. The ion electricity detecting circuit detects ion electricity.

The switching element and the like are operated when an ignition timing signal is transmitted from the ECU to the igniter 722 in the ignition coil 1. The switching element of the igniter 722 instantaneously supplies electricity to the primary coil 21, and stops supplying the electricity, so that the primary coil 21 generates magnetic flux passing through the center core 4, the outer core 23, and the permanent magnets 25. This magnetic flux causes an interlinkage with respect to the secondary coil 22, so that the secondary coil 22 generates induced electromotive force by electromagnetic induction. Thus, the sparkplug attached to the plug holder 711 of the ignition coil 1 generates spark.

As follows, effects of the ignition coil 1 in this example embodiment are described.

The secondary spool 3 of the ignition coil 1 has the first and second tapered inner surfaces 32, 34. Each of the first and second tapered inner surfaces 32, 34 has the diameter that increases as being distant from the tip end 201 of the cylindrical portion 2. The center core 4 has the first and second tapered outer surfaces 42, 44. Each of the first and second tapered outer surfaces 42, 44 has the diameter that increases as being distant from the tip end 201 of the cylindrical portion 2.

Conventionally, the tapered inner surfaces 32, 34 of the secondary spool 3 and the center core 4 form a redundant gap therebetween. However, in this example embodiment, the tapered outer surfaces 42, 44 are arranged in this conventional redundant gap, so that the outer diameter of the center core 4 increases, and the cross sectional area of the center core 4 increases in this portion corresponding to the conventional gap. In this structure, the dimension of the ignition coil does not necessarily become large, compared with the conventional structure.

Therefore, an amount of magnetic flux, which is generated by the primary coil 21, passing through the center core 4 can be increased, so that induced electromotive force generated in the secondary coil 22 can be enhanced. Thus, degree of spark generated using the spark plug can be increased. Consequently, output power and performance of the ignition coil 1 can be enhanced, without changing the outer dimension thereof, in general.

In this structure, the ignition coil 1 is capable of producing performance, which is equivalent to that of the conventional ignition coil 1, even the dimension of the ignition coil 1 is reduced. That is, the ignition coil 1 can be downsized, while maintaining the performance.

The rear end 402 of the center core 4 has the large diameter portion 49, which has the diameter largest of the center core 4. Leakage of magnetic flux, which passes through the center core 4, is apt to become large in the rear end 402 of the center core 4, in general. In the structure of this example embodiment, the large diameter portion 49 is arranged in the rear end 402, so that leakage of magnetic flux can be significantly reduced. In addition, magnetic flux, which passes through the center core 4, can be enhanced.

The large diameter portion 49 is arranged on the side of the rear end with respect to the winding region, in which the secondary coil 22 is wound around the secondary spool 3. In this structure, the diameter of the large diameter portion 49 can be further increased, so that magnetic flux, which passes through the center core 4, can be further enhanced.

The secondary spool 3 has the rear end 302 having the first contact inner surface 38, with which the large diameter portion 49 of the center core 4 makes contact, so that the center axis of the center core 4 can be adjusted. The tip end 301 of the secondary spool 3 has the second contact inner surface 39, with which the first straight outer surface 41 of the tip end 401 the center core 4 makes contact, so that the center axis of the center core 4 can be adjusted. In this structure, misalignment of the center axis of the center core 4 can be sufficiently restricted in an actual application of the ignition coil 1. In addition, the center core 4 can be readily assembled to the inside of the secondary spool 3.

The permanent magnets 25 are provided to the axial ends of the center core 4. Each of the permanent magnets 25 generates magnetic flux in the direction opposite to the direction of magnetic flux generated using the primary coil 21, so that reverse bias can be applied using the magnetic flux of the permanent magnets 25. Thus, induced electromotive force generated in the secondary coil 22 can be enhanced. In this example embodiment, each of the axial ends of the center core 4 and corresponding one of the permanent magnets 25 have substantially the same diameter. Therefore, the effects described above can be further enhanced, as the outer diameter of the permanent magnet 25 becomes large, so that the effect produced by the reverse bias can be further enhanced.

The permanent magnet 25 may be omitted.

The center core 4 is formed of a dust core. Therefore, the shape of the center core 4 can be freely changed only by changing the shape of the surface of the die for forming the dust core, so that the center core 4 can be formed even when the center core 4 has a complicated shape. Thus, forming process of the center core 4, which has the tapered outer surfaces 42, 44, can be readily produced.

The soft magnetic material of the dust core may be various generally known materials and materials developed in future.

As described above, output power and performance of the ignition coil 1 can be enhanced, without changing the outer dimension thereof, in general.

The end of the center core on the low voltage side, i.e., the rear end is arranged on the low voltage side of the secondary coil. That is, the rear end is arranged on the rear end side of the secondary coil. In the above structure, a distance between the end of the center core on the low voltage side and the secondary coil on the low voltage side for securing electric insulation therebetween may be small, compared with the distance on the high voltage side therebetween. Therefore, the large diameter portion can be arranged on the low voltage side of the secondary coil.

Second Embodiment

Figure 3:
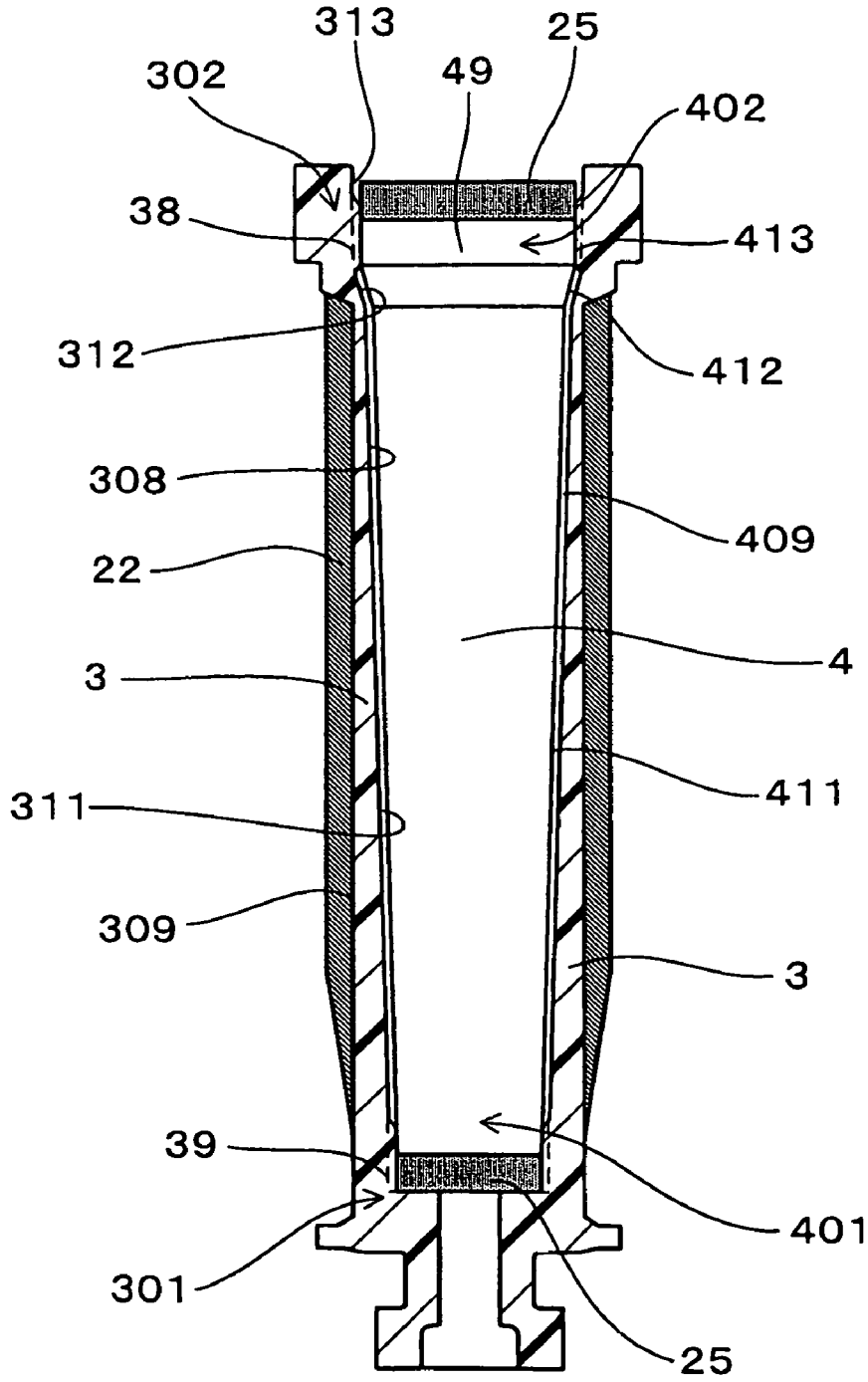
FIG. 3 is a partially cross sectional side view showing a secondary spool and a center core of an ignition coil, according to a second embodiment of the present invention.

As shown in FIG. 3, the secondary spool 3 of the ignition coil 1 has first and second tapered inner surfaces 311, 312. Each of the first and second tapered inner surfaces 311, 312 has the diameter that increases as being distant from the tip end 301 of the secondary spool 3. The secondary spool 3 further has a straight inner surface 313, which has the inner diameter substantially constant with respect to the axial direction thereof. The first tapered inner surface 311, the second tapered inner surface 312, and the straight inner surface 313 are arranged in this order from the side of the tip end 301 of the secondary spool 3.

The center core 4 has first and second tapered outer surfaces 411, 412. Each of the first and second tapered outer surfaces 411, 412 has the diameter that increases as being distant from the tip end 401 of the center core 4. The center core 4 further has a straight outer surface 413, which has the outer diameter substantially constant with respect to the axial direction thereof. The first tapered outer surface 411, the second tapered outer surface 412, and the straight outer surface 413 are arranged in this order from the side of the tip end 401 of the center core 4. In this example embodiment, the straight outer surface 413 defines the large diameter portion 49, which has the outer diameter largest of the center core 4.

The center core 4 has the outer circumferential surface 409, which is defined substantially along the inner circumferential surface 308 of the secondary spool 3, similarly to the structure in the first embodiment. That is, the inner circumferential surfaces of the secondary spool 3 and the outer circumferential surfaces of the center core 4 substantially oppose each other. Specifically, the first tapered inner surface 311 and the first tapered outer surface 411 substantially oppose each other. The second tapered inner surface 312 and the second tapered outer surface 412, and the straight inner surface 313 and the straight outer surface 413 substantially oppose each other.

Structures of the ignition coil 1 other than the above construction in this example embodiment are substantially similar to the structures in the first embodiment.

In this example embodiment, the tapered outer surfaces 411, 412 of the center core 4 are arranged in the conventional redundant gap between the tapered inner surfaces 311, 312 of the secondary spool 3 and the center core 4. Therefore, the outer diameter of the center core 4 increases, and the cross sectional area of the center core 4 increases in this portion corresponding to the conventional gap. In this structure, the dimension of the ignition coil does not necessarily become large, compared with the conventional structure. Therefore, the amount of magnetic flux passing through the center core 4 can be increased, without changing the outer dimension thereof, in general. Consequently, output power and performance of the ignition coil 1 can be enhanced, Effects other than the above characteristics are substantially similar to the effects in the first embodiment.

Third Embodiment

Figure 4:
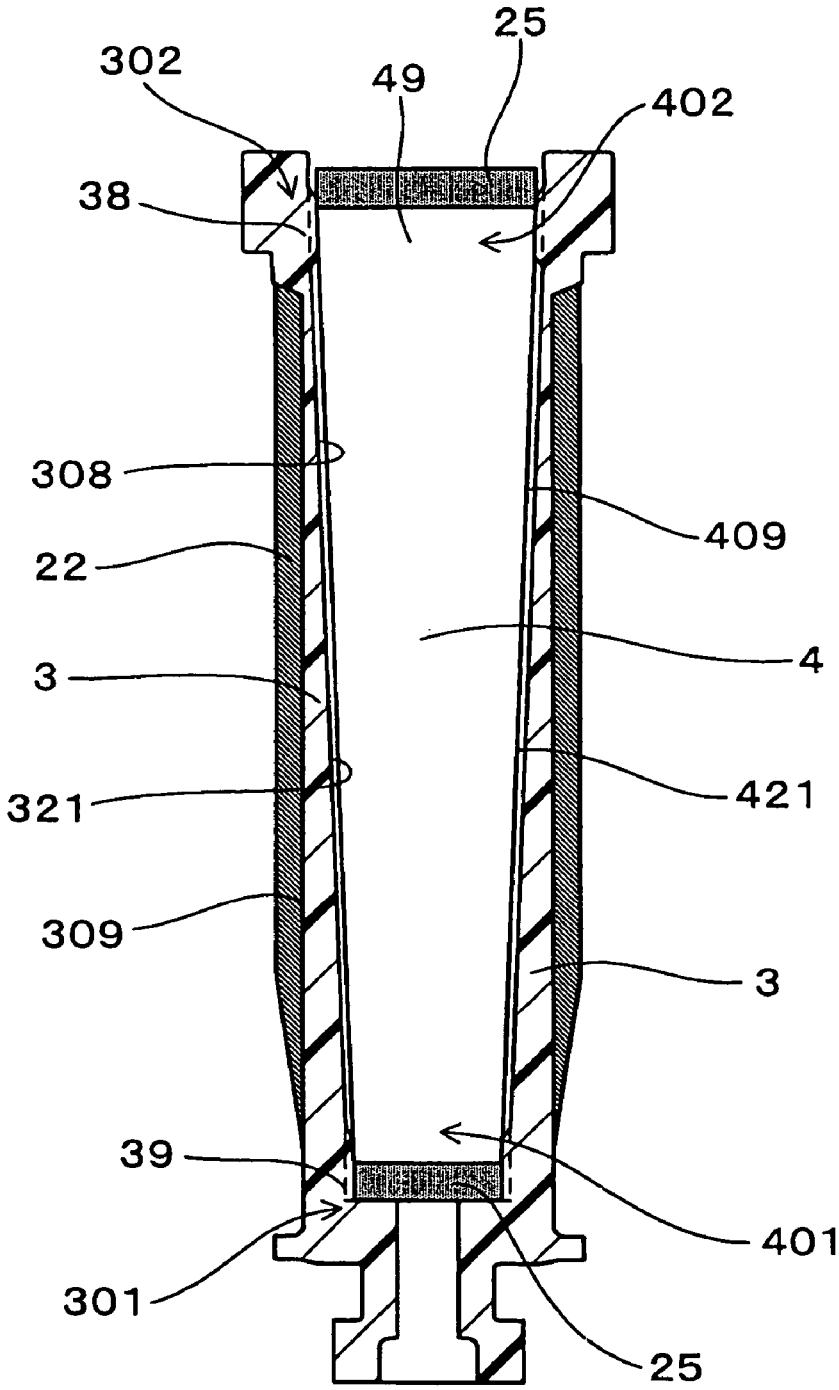
FIG. 4 is a partially cross sectional side view showing a secondary spool and a center core of an ignition coil, according to a third embodiment of the present invention.

As shown in FIG. 4, the secondary spool 3 of the ignition coil 1 has a tapered inner surface 321, which has the diameter that increases as being distant from the tip end 301 of the secondary spool 3. The center core 4 has a tapered outer surface 421, which has the diameter that increases as being distant from the tip end 401 of the center core 4.

In this example embodiment, the inner circumferential surface 308 of the secondary spool 3 and the outer circumferential surface 409 of the center core 4 entirely have the tapered shape, which respectively have the diameters that increase as being distant from the tip end 201 of the cylindrical portion 2. In this example embodiment, the rear end of the tapered outer surface 421 defines the large diameter portion 49, which has the outer diameter largest of the center core 4.

The outer circumferential surface 409 of the center core 4 is defined substantially along the inner circumferential surface 308 of the secondary spool 3, similarly to the structure in the first embodiment. That is, the tapered inner surface 321 of the secondary spool 3 and the tapered outer surface 421 of the center core 4 substantially oppose each other.

Structures of the ignition coil 1 other than the above construction in this example embodiment are substantially similar to the structures in the first embodiment.

In this example embodiment, the tapered outer surface 421 of the center core 4 are arranged in the conventional redundant gap between the tapered inner surface 321 of the secondary spool 3 and the center core 4. Therefore, the outer diameter of the center core 4 increases, and the cross sectional area of the center core 4 increases in this portion corresponding to the conventional gap. In this structure, the dimension of the ignition coil does not necessarily become large, compared with the conventional structure. Therefore, the amount of magnetic flux passing through the center core 4 can be increased, without changing the outer dimension thereof, in general. Consequently, output power and performance of the ignition coil 1 can be enhanced.

Effects other than the above characteristics are substantially similar to the effects in the first embodiment.

Fourth Embodiment

Figure 5:
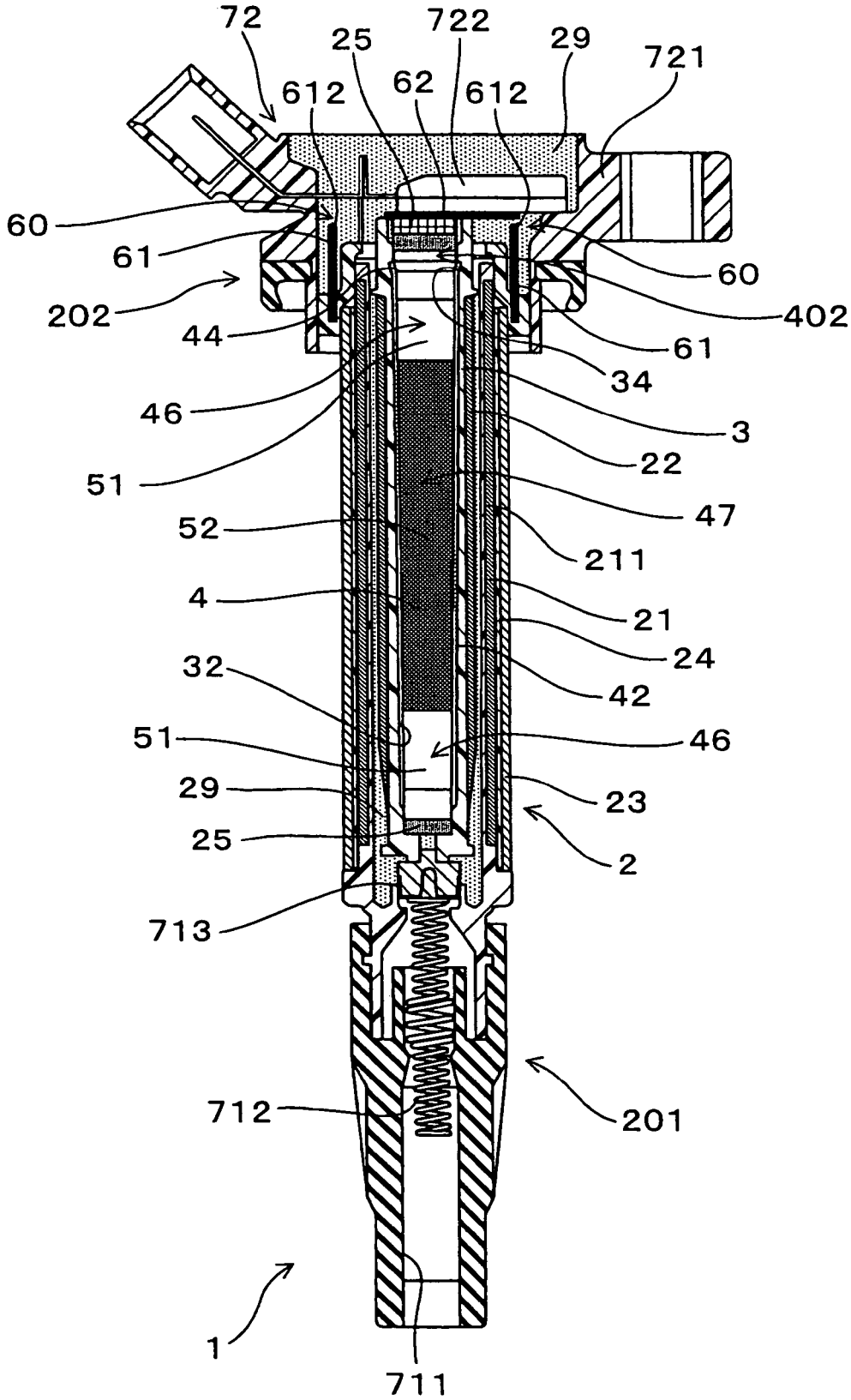
FIG. 5 is a partially cross sectional side view showing an ignition coil, according to a fourth embodiment of the present invention.
Figure 6:
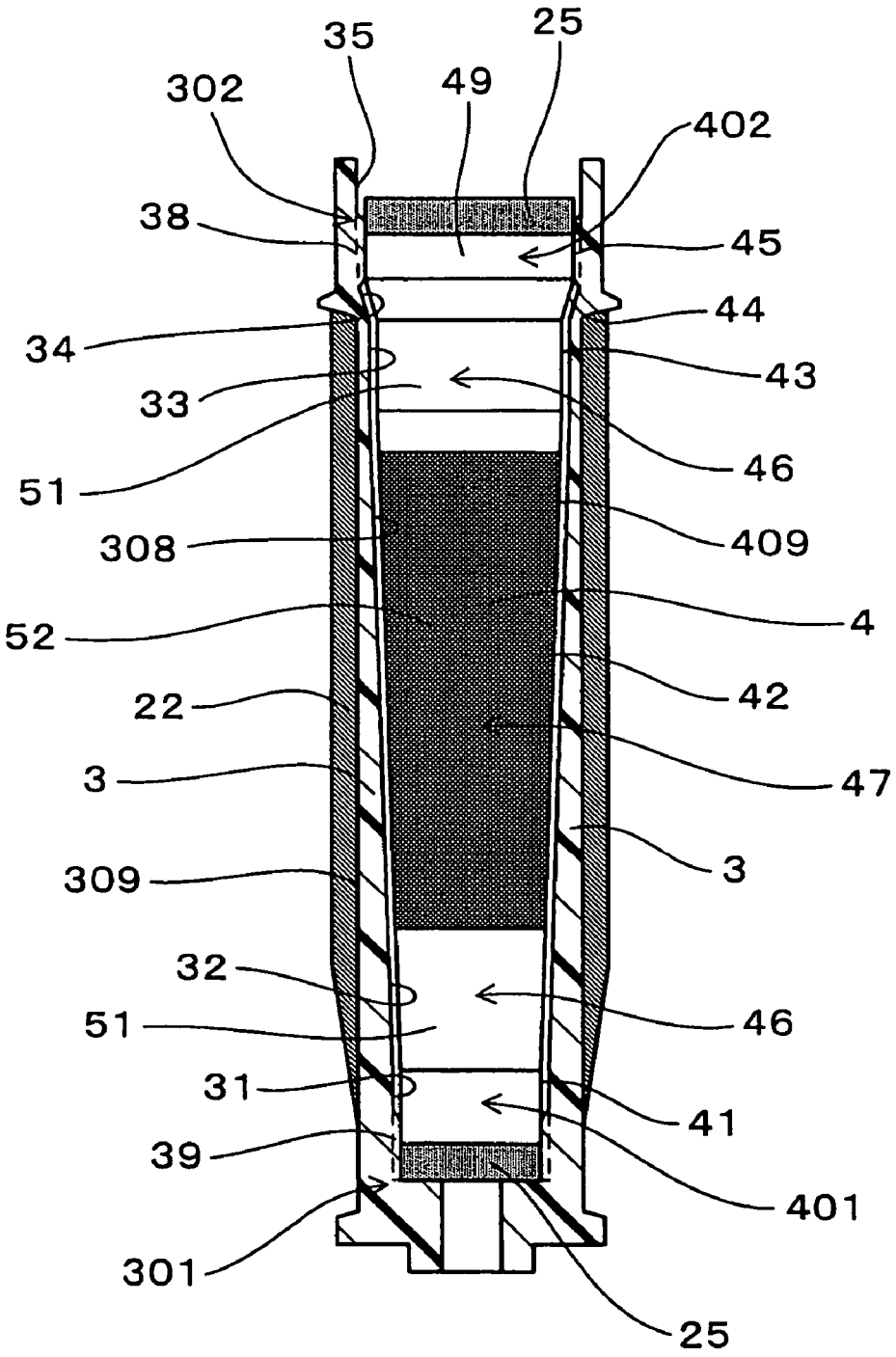
FIG. 6 is a partially cross sectional side view showing a secondary spool and a center core of the ignition coil, according to the fourth embodiment.

In this example embodiment, as shown in FIGS. 5, 6, a side plate 61 and an upper plate 62 are provided to the rear end 202 of the cylindrical portion 2 of the ignition coil 1, which has a partially modified structure of the ignition coil 1 and the center core 4 in the first embodiment.

Referring to FIG. 5, the secondary coil 22 is inserted into the inside of the primary coil 21 of the ignition coil 1. The center core 4 formed of the dust core is inserted into the inside of the secondary coil 22. The primary coil 21 is inserted into the inside of a thin walled cylinder 24, which is formed of resin to be in a substantially cylindrical shape. The outer core 23 formed of metal to be in a substantially cylindrical shape is arranged on the outer circumferential surface of the thin walled cylinder 24. The electrically insulative resin 29 is filled in all the gap between the center core 4 and the secondary coil 22, the gap between the secondary coil 22 and the primary coil 21, and the gap between the primary coil 21 and the thin walled cylinder 24.

The rear end portion 202 of the cylindrical portion 2 has a non-lapping region 60, in which the rear end 402 of the center core 4 is arranged on the axially rear side with respect to the outer core 23. The center core 4 and the outer core 23 do not radially overlap in the non-lapping region 60. The side plate 61 is provided in the non-lapping region 60. The side plate 61 is formed of a soft magnetic material to be in a substantially cylindrical shape. The side plate 61 at least partially covers the non-lapping region 60 on the circumferentially outer side thereof.

The upper plate 62 is provided to the rear end portion 202 of the cylindrical portion 2. The upper plate 62 is formed of a soft magnetic material to be in a substantially flat plate shape. The upper plate 62 is opposed to an axial rear end 612 of the side plate 61 and the rear end 402 of the center core 4.

Referring to FIG. 6, the center core 4 includes end portions 46. Each of the end portions 46 occupies 15% or greater of the corresponding axial end of the center core 4. The end portions 46 are formed of a first soft magnetic material 51. The center core 4 excluding the end portions 46 construct a center portion 47, which is formed of a second soft magnetic material 52. The second soft magnetic material 52 has a saturation magnetic flux density, which is greater than that of the first soft magnetic material 51. In this example embodiment, the first soft magnetic material 51 is formed of ferrous powder, which has a saturation magnetic flux density of 1.6 (T). The second soft magnetic material 52 is formed of Permendur, which has a saturation magnetic flux density of 2.3 (T). This Permendur is an alloy, which has a high magnetic flux density. The Permendur is composed of iron, which is a soft magnetic material, and cobalt. Specifically, the Permendur contains substantially 50 wt % of cobalt.

The center portion 47 of the center core 4 may be partially formed of the second soft magnetic material 52. In this structure, the location of the second soft magnetic material 52 can be variously arranged in the center core 4.

The shapes of the secondary spool 3 and the center core 4 are substantially equivalent to those in the first embodiment (FIG. 2). Specifically, the first straight inner surface 31 and the first straight outer surface 41, and the first tapered inner surface 32 and the first tapered outer surface 42 substantially oppose each other. The second straight inner surface 33 and the second straight outer surface 43, the second tapered inner surface 34 and the second tapered outer surface 44, and the third straight inner surface 35 and the third straight outer surface 45 substantially oppose each other.

Structures of the ignition coil 1 other than the above construction in this example embodiment are substantially similar to the structures in the first embodiment, in general.

In the structure of this example embodiment, the side plate 61 and the upper plate 62 are provided to the ignition coil 1, so that leakage of magnetic flux can be significantly reduced in the rear end 202 of the cylindrical portion 2 including the non-lapping region 60. Thus, magnetic flux generated in the primary coil 21 is capable of efficiently passing through the magnetic circuit constructed of the side plate 61 and the upper plate 62 in addition to the center core 4, the outer core 23, and the permanent magnets 25. Consequently, output power and performance of the ignition coil 1 can be enhanced.

The center core 4 includes the center portion 47, which is formed of the second soft magnetic material 52 having the saturation magnetic flux density greater than that of the first soft magnetic material 51. When the primary coil 21 generates magnetic flux, magnetic flux density becomes high in the center portion 47, so that leakage of magnetic flux becomes small in the center portion 47. Therefore, magnetic flux passing through the center core 4 can be efficiently enhanced. A material, which has a high magnetic flux density, is expensive, in general. In this structure, such an expensive material is used in a limited portion, which is needed to produce high magnetic flux density. Therefore, the structure in this example embodiment becomes inexpensive, compared with a structure, in which the center core 4 is entirely formed of a material, which has a high magnetic flux density. In addition, output power and performance of the ignition coil 1 can be enhanced in the structure.

In this example embodiment, the above effects are added to the effects of the first embodiment. Specifically, in the first embodiment, the tapered outer surfaces 42, 44 of the center core 4 are arranged in the conventional redundant gap between the tapered inner surfaces 32, 34 of the secondary spool 3 and the center core 4 without changing the outer dimension thereof, in general. Therefore, the cross sectional area of the center core 4 increases in this portion corresponding to the conventional gap, so that the amount of magnetic flux passing through the center core 4 can be increased, similarly to the first embodiment. Consequently, output power and performance of the ignition coil 1 can be further enhanced.

Fifth Embodiment

Figure 7:
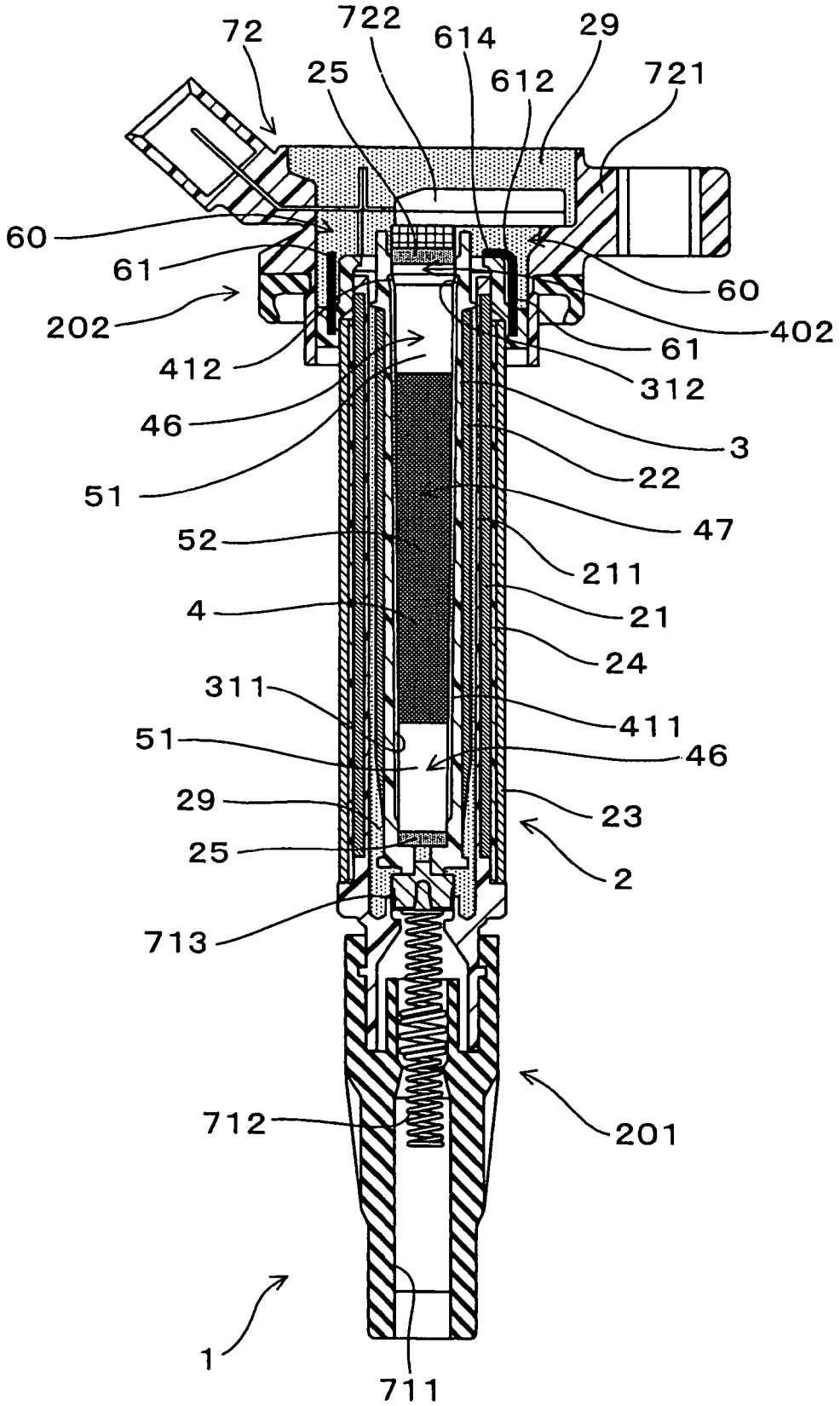
FIG. 7 is a partially cross sectional side view showing an ignition coil, according to a fifth embodiment of the present invention.
Figure 8:
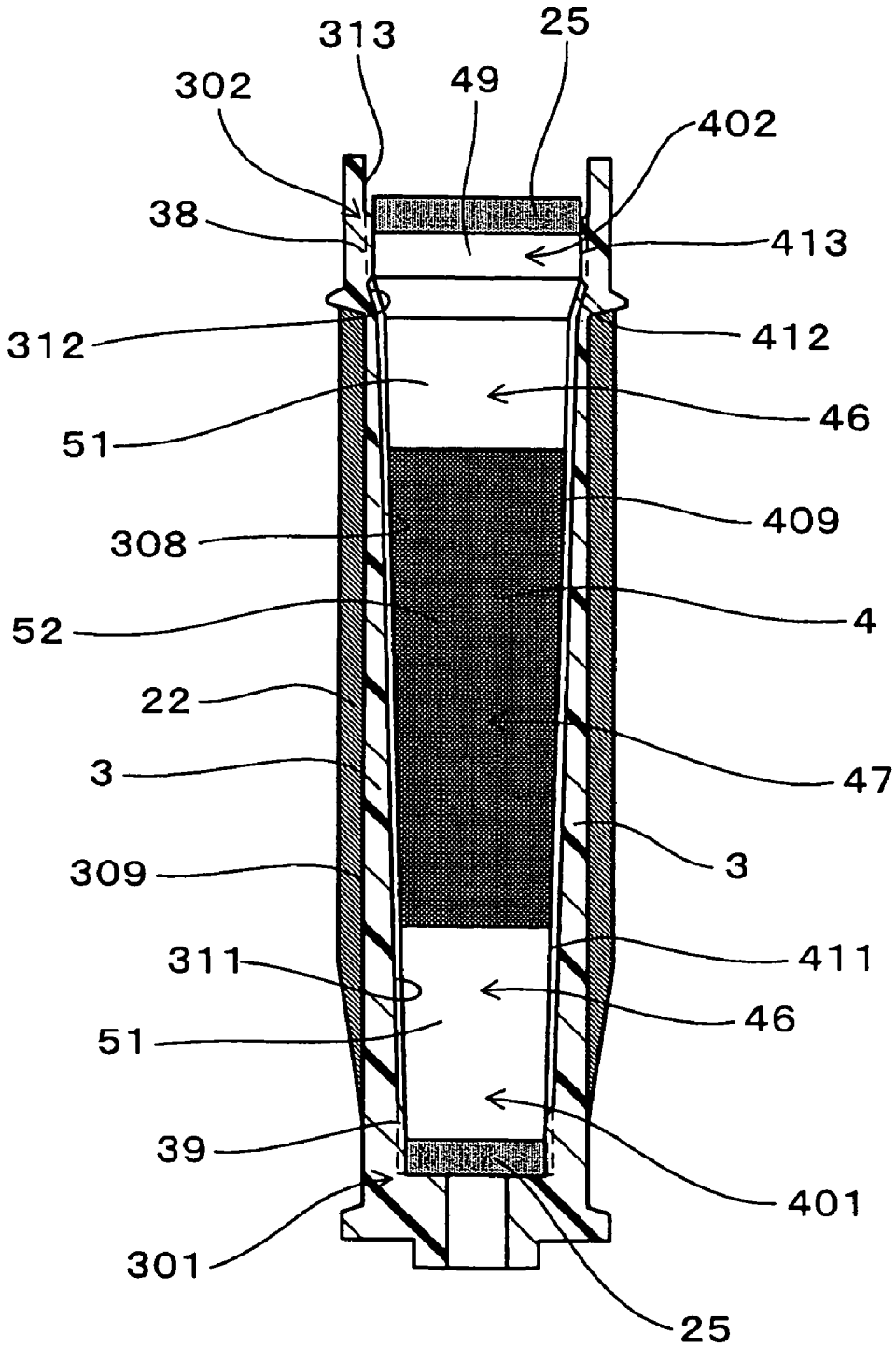
FIG. 8 is a partially cross sectional side view showing a secondary spool and a center core of the ignition coil, according to the fifth embodiment.

As shown in FIGS. 7, 8, in this example embodiment, the shapes of the secondary spool 3, the center core 4, and the side plate 61 are modified compared with the ignition coil 1 of the fourth embodiment. In addition, the upper plate 62 is omitted from the ignition coil 1 of the fourth embodiment.

Referring to FIG. 7, a side plate 61 is arranged in the non-lapping region 60 formed in the rear end 202 of the cylindrical portion 2. The side plate 61 is formed of a soft magnetic material to be in a substantially cylindrical shape. This side plate 61 has a bent end 614, which is formed by bending the axial rear end 612 at least partially to the inside. The bent end 614 has the inner circumferential end, which is opposed to the side surface of the permanent magnet 25 provided to the rear end 402 of the center core 4. When the permanent magnet 25 is not provided, the inner circumferential surface of the bent end 614 is opposed to the side surface of the center core 4.

Referring to FIG. 8, the shapes of the secondary spool 3 and the center core 4 are similar to those in the second embodiment shown in FIG. 3. Specifically, the first tapered inner surface 311 and the first tapered outer surface 411, the second tapered inner surface 312 and the second tapered outer surface 412, and the straight inner surface 313 and the straight outer surface 413 substantially oppose each other.

Structures of the ignition coil 1 other than the above construction in this example embodiment are substantially similar to the structures in the fourth embodiment, in general.

In the structure of this example embodiment, the bent end 614 of the side plate 61 has a function similar to that of the upper plate 62 in the fourth embodiment. Therefore, leakage of magnetic flux becomes small in the rear end 202 of the cylindrical portion 2, similarly to the structure, in which the upper plate 62 is provided, so that magnetic flux passing through the magnetic circuit can be efficiently enhanced.

In this example embodiment, the tapered outer surfaces 411, 412 of the center core 4 are arranged in the conventional redundant gap between the tapered inner surfaces 311, 312 of the secondary spool 3 and the center core 4, without changing the outer dimension of the ignition coil 1, in general. Therefore, the cross sectional area of the center core 4 increases in this portion corresponding to the conventional gap, so that the amount of magnetic flux passing through the center core 4 can be increased.

Structures of the ignition coil 1 other than the above construction in this example embodiment are substantially similar to the structures in the fourth embodiment, in general. Consequently, output power and performance of the ignition coil 1 can be further enhanced.

Sixth Embodiment

Figure 9:
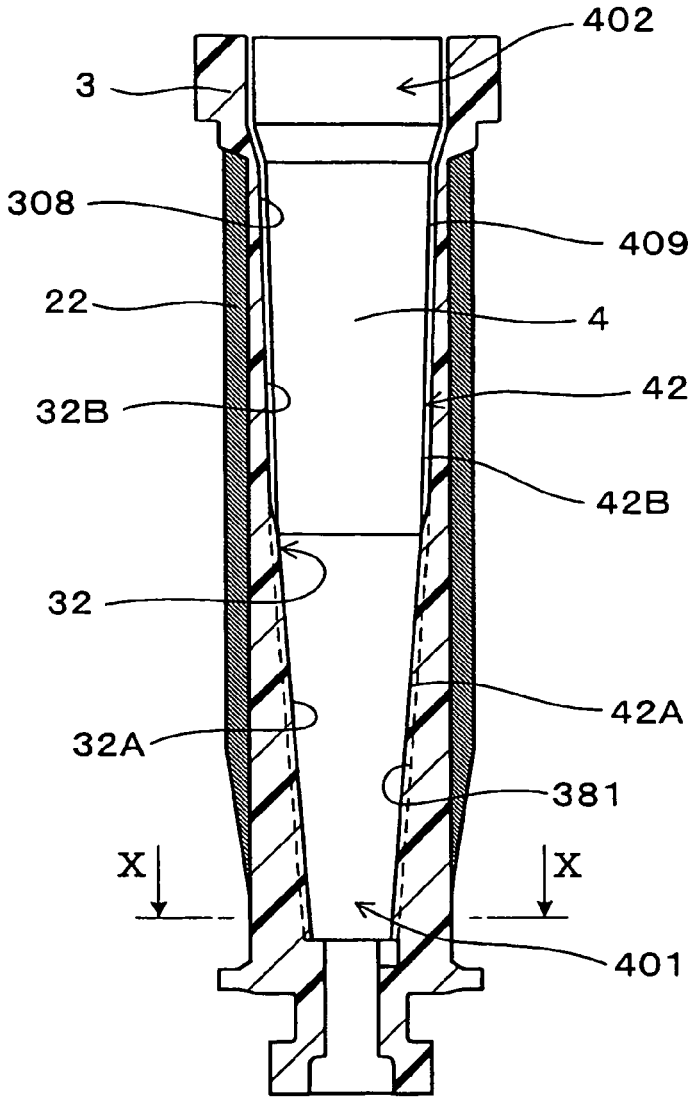
FIG. 9 is a partially cross sectional side view showing a secondary spool and a center core of an ignition coil, according to the sixth embodiment.
Figure 10:
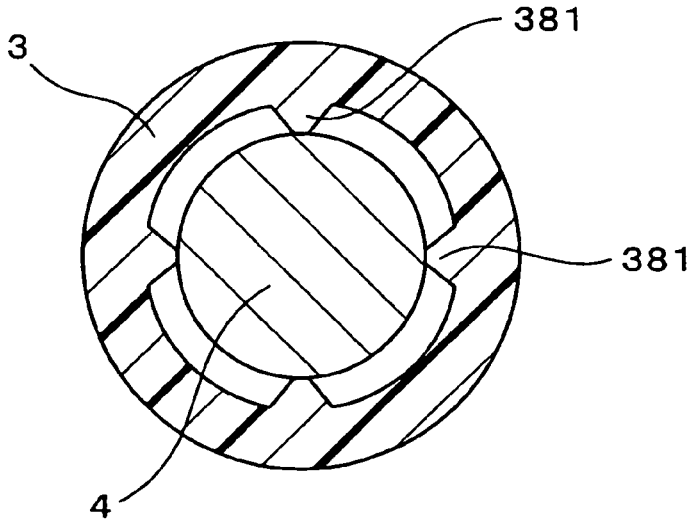
FIG. 10 is a cross sectional view taken along the line X-X in FIG. 9.

As shown in FIGS. 9, 10, in this example embodiment, centering protrusions 381 are provided to the tapered inner surface 32 of the secondary spool 3. Each of the centering protrusion 381 makes contact with the tapered outer surface 42 of the center core 4, thereby aligning the center axis of the center core 4 with respect to the center axis of the secondary spool 3.

In this example embodiment, the centering protrusions 381 are formed integrally with the secondary spool 3 from the side of the high voltage end of the tapered inner surface 32 to a substantially center portion thereof. The centering protrusions 381 are formed in multiple locations with respect to the circumferential direction of the tapered inner surface 32 of the secondary spool 3. In this example embodiment, four of the centering protrusions 381 are formed in the tapered inner surface 32 circumferentially at substantially regular intervals. Preferably, at least three of the centering protrusions 381 are formed circumferentially in the tapered inner surface 32, in order to reduce the area, via which each of the centering protrusions 381 makes contact with the center core 4. Thus, an assembling work of the center core 4 into the secondary spool 3 can be facilitated.

Referring to FIG. 9, in this example embodiment, the first tapered inner surface 32 of the secondary spool 3 has the tapered angle, which changes on the inner circumferential side with respect to the winding region, in which the secondary coil 22 is wound around the secondary spool 3. Specifically, the first tapered inner surface 32 has a steep tapered inner surface 32A and a gentle tapered inner surface 32B on the inner circumferential side of the winding region in the secondary spool 3. The steep tapered inner surface 32A, which has a steep tapered angle, is located on the high voltage side in the secondary spool 3. The gentle tapered inner surface 32B is located on the low voltage side in the secondary spool 3. The gentle tapered inner surface 32B has a tapered angle, which is gentler than the tapered angle of the steep tapered inner surface 32A. The centering protrusions 381 are formed in the steep tapered inner surface 32A, for example.

The tapered outer surface 42 of the center core 4 has a steep tapered outer surface 42A and a gentle tapered outer surface 42B. The steep tapered outer surface 42A is opposed to the steep tapered inner surface 32A, thereby being pressed by the centering protrusions 381. The gentle tapered outer surface 42B is opposed to the gentle tapered inner surface 32B.

Structures of the ignition coil 1 other than the above construction in this example embodiment are substantially similar to the structures in the first embodiment, in general. Effects similar to those in the first embodiment can be produced by the structure of this example embodiment.

Seventh Embodiment

Figure 11:
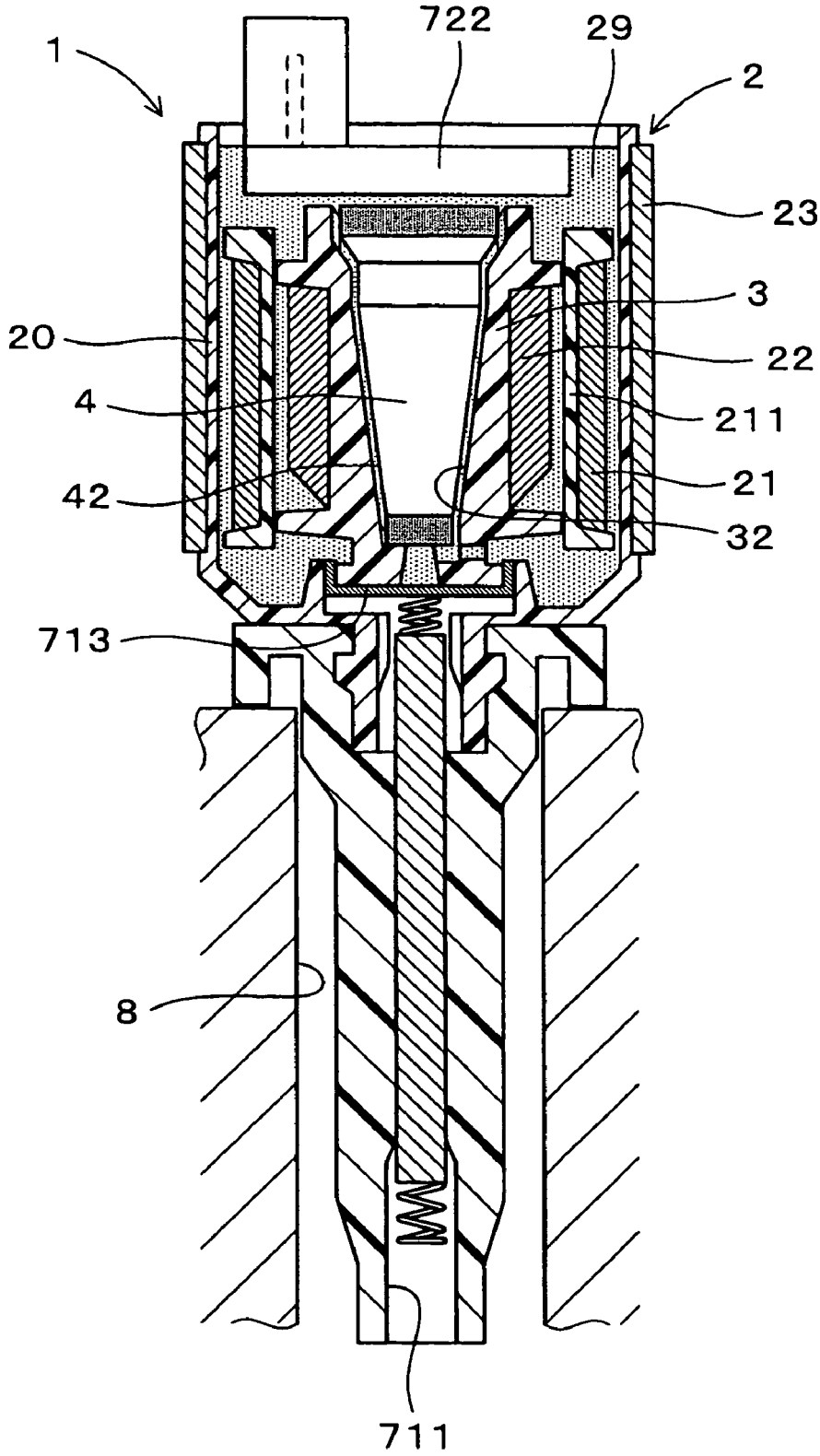
FIG. 11 is a partially cross sectional side view showing an ignition coil, according to a seventh embodiment of the present invention.
Figure 12:
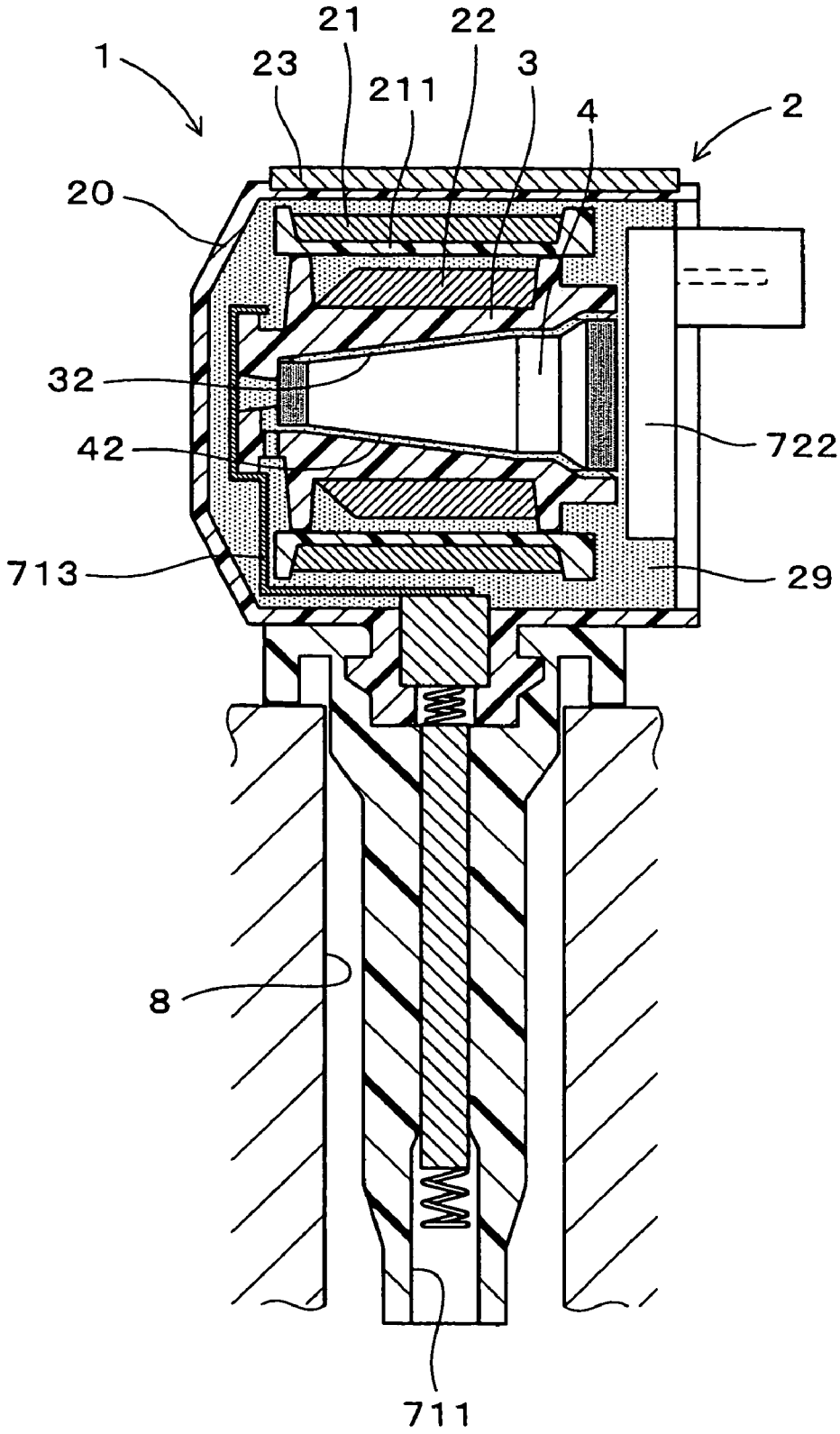
FIG. 12 is a partially cross sectional side view showing another ignition coil, according to the seventh embodiment.

As shown in FIGS. 11, 12, in this example embodiment, the ignition coil 1 has an externally arranged structure including a head portion 2, which accommodates the primary coil 21, the secondary coil 22, and the center core 4. The head portion 2 is arranged outside of the plughole 8 of the engine. The plug holder 711 arranged in the plughole 8 is to be connected with the spark plug.

Referring to FIG. 11, the axial direction of the head portion 2 is substantially in parallel with the axial direction of the plug holder 711, which is inserted into the plughole 8. In this example embodiment, the plug holder 711 is provided to one axial end of the coil case 20, which accommodates the primary coil 21, the secondary coil 22, and the center core 4.

The ignition coil 1 in this example embodiment may be modified, as referred to FIG. 12. Specifically, the axial direction of the head portion 2 may be arranged substantially perpendicular to the axial direction of the plug holder 711, which is inserted into the plughole 8. In this structure, the plug holder 711 may be arranged to the lateral side of the coil case 20, which accommodates the primary coil 21, the secondary coil 22, and the center core 4.

The secondary spool 3 has the tapered inner surface 32, and the like. The center core 4 has the tapered outer surface 42, and the like.

Structures of the ignition coil 1 other than the above construction in this example embodiment are substantially similar to the structures in the first embodiment, in general. Effects similar to those in the first embodiment can be produced by the structure of this example embodiment.

Eighth Embodiment

Figure 13:
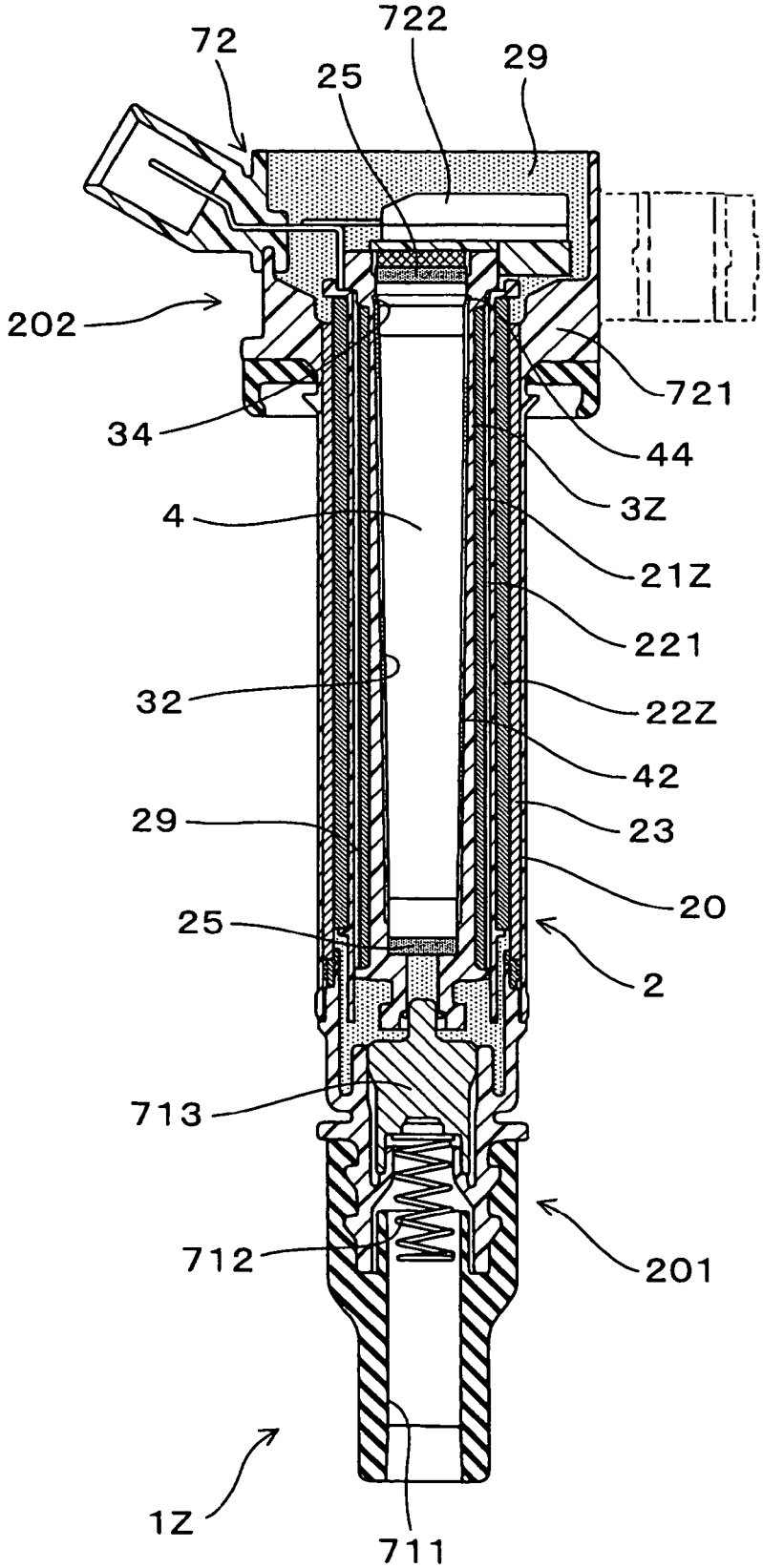
FIG. 13 is a partially cross sectional side view showing an ignition coil, according to an eighth embodiment of the present invention.
Figure 14:
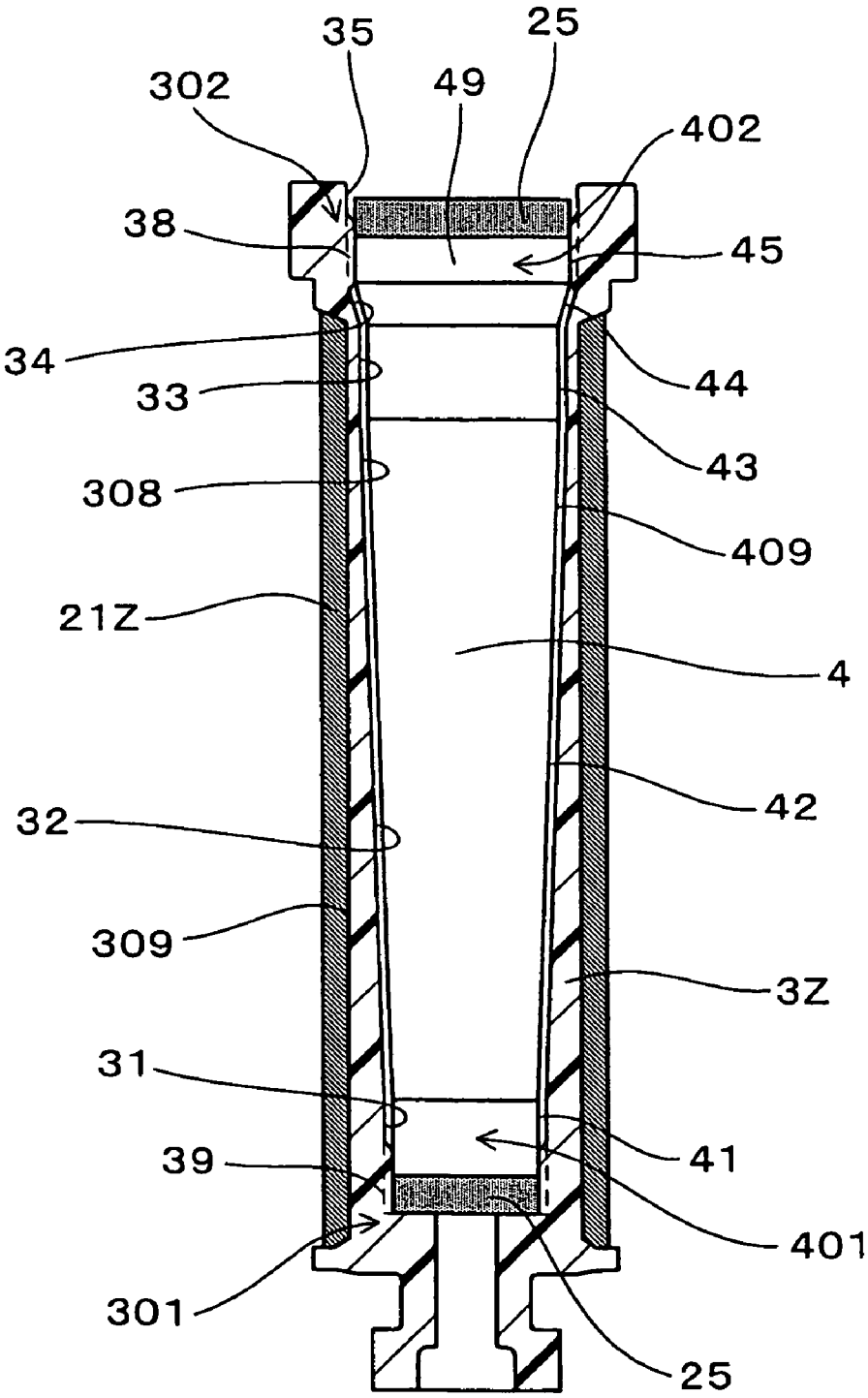
FIG. 14 is a partially cross sectional side view showing a secondary spool and a center core of the ignition coil, according to the eighth embodiment.

As shown in FIGS. 13, 14, in this example embodiment, an ignition coil 1Z has a primary coil 21Z and a secondary coil 22Z. The primary coil 21Z is the inner coil, which is arranged on the circumferentially inner side of the secondary coil 22Z. In this structure, the primary spool 3Z, on which the primary coil 21Z is wound, accommodates the center core 4 therein. The secondary coil 22Z is wound around a secondary spool 221, which is in a substantially cylindrical shape.

Structures of the ignition coil 1Z other than the above construction in this example embodiment are substantially similar to the structures in the first embodiment, in general. Effects similar to those in the first embodiment can be produced by the structure of this example embodiment. The structure of this example embodiment can be applied to the structures in the above second to seventh embodiments.

Ninth Embodiment

Figure 15:
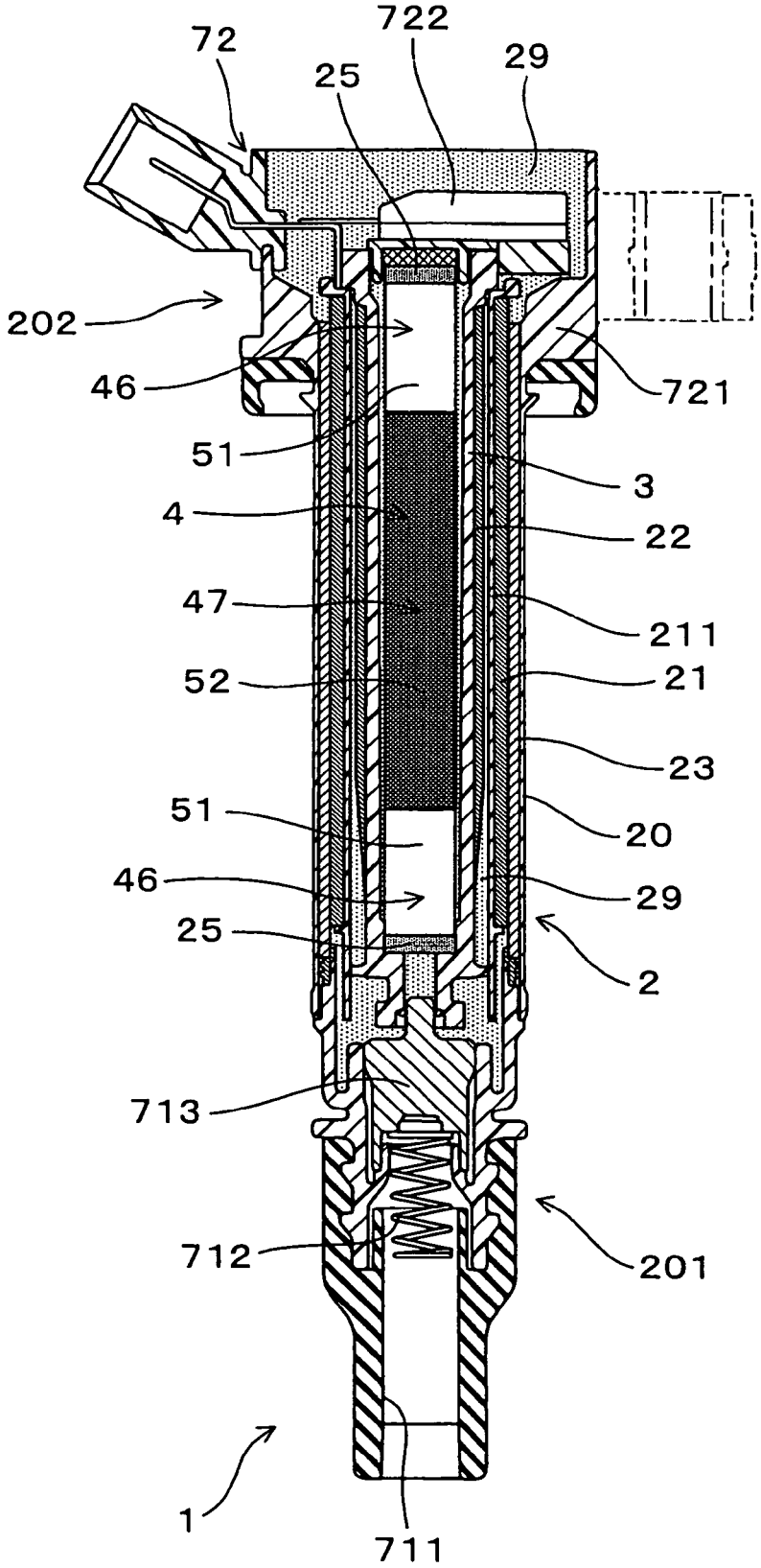
FIG. 15 is a partially cross sectional side view showing an ignition coil, according to a ninth embodiment of the present invention.

As shown in FIG. 15, the ignition coil 1 includes the cylindrical portion 2 that accommodates the primary coil 21, the secondary coil 22, and the center core 4, which are coaxially arranged. The cylindrical portion 2 has the tip end 201, on which the plug holder 711 is formed.

Figure 16:
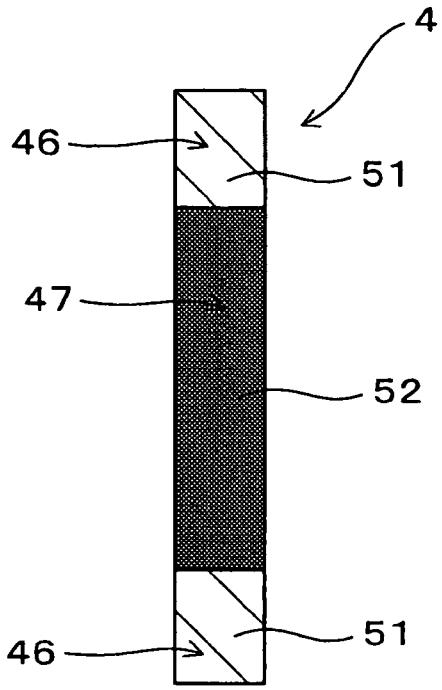
FIG. 16 is a cross sectional side view showing a center core of the ignition coil, according to the ninth embodiment.

As shown in FIG. 16, the center core 4 includes the end portions 46. Each of the end portions 46 occupies 15% or greater of the corresponding axial end of the center core 4. The end portions 46 are formed of the first soft magnetic material 51. The center core 4 excluding the end portions 46 construct the center portion 47, which is formed of the second soft magnetic material 52. The second soft magnetic material 52 has a saturation magnetic flux density, which is greater than that of the first soft magnetic material 51.

Referring to FIG. 15, the cylindrical portion 2 of the ignition coil 1 is constructed of the resinous coil case 20, into which the outer core 23, the primary coil 21, the secondary coil 22, and the center core 4 are inserted. The primary coil 21 is constructed of an electrically insulative wire, which is wound around the outer circumferential surface of the primary spool 211. The primary spool 211 is formed of resin to be in a substantially cylindrical shape. The secondary coil 22 is constructed of an electrically insulative wire, which is wound around the outer circumferential surface of the secondary spool 3. The secondary spool 3 is formed of resin to be in a substantially cylindrical shape. The wire of the secondary coil 22 is wound for a winding number, which is greater than a winding number of the primary coil 21. Alternatively, the primary coil 21 may be formed by winding an electrically insulative wire to be in a substantially cylindrical shape, and joining the wire using a fusion material or the like.

The primary coil 21 is inserted into the outer core 23, which is formed of metal to be in a substantially cylindrical shape. The outer core 23 is inserted into the coil case 20. The secondary coil 22 is inserted into the inner circumferential side of the primary coil 21. The center core 4 is arranged inside of the inner circumferential side of the secondary core 22. The center core 4 is formed of a dust core. The center core 4 has both axial ends, to which the permanent magnets 25 are respectively provided. Each of the permanent magnets 25 has the outer diameter, which is substantially the same as the outer diameter of the corresponding end of the center core 4. The permanent magnets 25 are arranged such that each of the permanent magnets 25 generates magnetic flux in a direction opposite to the direction of magnetic flux generated using the primary coil 21. The primary coil 21 is supplied with electricity, so that the primary coil 21 generates magnetic flux. The magnetic flux passes through the magnetic circuit, which is constructed of the center core 4, the outer core 23, and the permanent magnet 25, thereby being enhanced.

The electrically insulative resin 29 is filled in all the gap between the center core 4 and the secondary coil 22, the gap between the secondary coil 22 and the primary coil 21, and the gap between the primary coil 21 and the outer core 23. The electrically insulative resin 29 is epoxy resin in this example embodiment.

As shown in FIG. 16, the center core 4 includes the end portions 46. Each of the end portions 46 occupies a volume between 15% and 25% of the corresponding axial end of the center core 4, for example. The end portions 46 are formed of the first soft magnetic material 51. The center core 4 excluding the end portions 46 construct the center portion 47, which is formed of the second soft magnetic material 52. The second soft magnetic material 52 has a saturation magnetic flux density, which is greater than that of the first soft magnetic material 51.

The center core 4 is formed of the dust core, which is shaped by compressing powder of a soft magnetic material, for example. Specifically, the center core 4 can be formed by filling powder of the first and second soft magnetic materials 51, 52 into a predetermined location in a die for a predetermined amount, and hot pressing the powder, for example. The location of the first and second soft magnetic materials 51, 52 can be readily changed variously in the center core 4, by changing the predetermined location, in which the first and second soft magnetic materials 51, 52 are filled into the die.

The shape of the outer surface of the dust core can be freely defined by the surface of the die. Therefore, it is advantageous to form the center core 4 of a dust core, when the shape of the outer circumferential surface is complicated in the structure of the center core 4.

The first soft magnetic material 51 is formed of ferrous powder, which has a saturation magnetic flux density of 1.6 (T). The second soft magnetic material 52 is formed of Permendur, which has a saturation magnetic flux density of 2.3 (T). This Permendur is an alloy, which has a high magnetic flux density, composed of iron (Fe) and cobalt (Co). Specifically, the Permendur contains substantially 50 wt % of cobalt.

Referring to FIG. 15, the tip end 711 of the cylindrical portion 2 has the plug holder 711, to which a spark plug is to be attached. The plug holder 711 has a coil spring 712, which makes contact with the spark plug. The coil spring 712 is electrically connected with an end of the winding of the secondary coil 22 on the high voltage side via the high voltage terminal 713.

The cylindrical portion 2 has the rear end 202 having the igniter portion 72. The igniter portion 72 has the igniter case 721, which accommodates the igniter 722 for supplying electric power to the primary coil 21. The igniter 722 is embedded in the electrically insulative resin 29 in a condition where the igniter 722 is arranged in the igniter case 721. The igniter 722 includes an electric power control circuit, an ion electricity detecting circuit, and the like. The electric power control circuit includes a switching element, which is operated by a signal transmitted from the ECU, and the like. The ion electricity detecting circuit detects ion electricity.

The switching element and the like are operated when an ignition timing signal is transmitted from the ECU to the igniter 722 in the ignition coil 1. The switching element of the igniter 722 instantaneously supplies electricity to the primary coil 21, and stops supplying the electricity, so that the primary coil 21 generates magnetic flux passing through the center core 4, the outer core 23, and the permanent magnets 25. This magnetic flux causes an interlinkage with respect to the secondary coil 22, so that the secondary coil 22 generates induced electromotive force by electromagnetic induction. Thus, the sparkplug attached to the plug holder 711 of the ignition coil 1 generates spark.

As follows, effects of the ignition coil 1 in this example embodiment are described.

The center core 4 includes the end portions 46 occupying respectively 15% or greater of both the axial ends of the center core 4. The end portions 46 are formed of the first soft magnetic material 51. The center core 4 excluding the end portions 46 construct the center portion 47, which is formed of the second soft magnetic material 52. The second soft magnetic material 52 has the saturation magnetic flux density, which is greater than that of the first soft magnetic material 51.

The primary coil 21 generates magnetic flux passing through the center core 4 in the ignition coil 1 by supplying electricity to the primary coil 21. Leakage of magnetic flux becomes large in the axial ends of the center core 4. Therefore, the magnetic flux density in the center core 4 becomes small, as approaching to the axial ends of the center core 4, compared with that in the axial center of the center core 4.

In this structure of the ignition coil 1, the center core 4 includes the center portion 47, which is formed of the second soft magnetic material 52 having the saturation magnetic flux density greater than that of the first soft magnetic material 51. When the primary coil 21 generates magnetic flux, magnetic flux density becomes high in the center portion 47, so that magnetic flux becomes large in the center portion 47. Thus, leakage of magnetic flux becomes small in the center portion 47. Therefore, magnetic flux passing through the center core 4 can be efficiently enhanced.

Thus, an amount of magnetic flux, which is generated by the primary coil 21, passing through the center core 4 can be increased, so that induced electromotive force generated in the secondary coil 22 can be enhanced. Therefore, degree of spark generated using the spark plug can be increased. Consequently, output power and performance of the ignition coil 1 can be enhanced, without changing the outer dimension thereof, in general.

A material, which has a high magnetic flux density, is expensive, in general. In this structure, such an expensive material is used in a limited portion, which is needed to produce high magnetic flux density. Therefore, the structure in this example embodiment becomes inexpensive, compared with a structure, in which the center core 4 is entirely formed of a material, which has a high magnetic flux density. In addition, output power and performance of the ignition coil 1 can be enhanced in the structure.

The center portion 47 of the center core 4 is substantially entirely formed of the second soft magnetic material 52. The second soft magnetic material 52 is formed of the Permendur, which is a material having a high magnetic flux density such as 2.3 (T). Therefore, the center portion 47 of the center core 4 is capable of generating high magnetic flux density, so that magnetic flux passing through the center core 4 can be further efficiently enhanced. The center portion 47 of the center core 4 may be partially formed of the second soft magnetic material 52.

The first soft magnetic material 51 is formed of ferrous powder, which is a generally used relatively inexpensive material. The first soft magnetic material 51 has a favorable characteristic, so that sufficient magnetic flux can be produced, even in the end portions 46 of the center core 4.

The center core 4 is formed of the dust core. Therefore, the construction of the center core 4 can be readily changed, by variously changing the predetermined location, in which the first and second soft magnetic materials 51, 52 are filled into the die.

The shape of the outer surface of the dust core can be freely defined by the surface of the die, thereby being adapted to a complicated shape.

The permanent magnets 25 are provided to the axial ends of the center core 4. Each of the permanent magnets 25 generates magnetic flux in the direction opposite to the direction of magnetic flux generated using the primary coil 21, so that reverse bias can be applied using the magnetic flux of the permanent magnets 25. Thus, induced electromotive force generated in the secondary coil 22 can be enhanced. The effect of the reverse bias can be further enhanced, as the outer diameter of the permanent magnet 25 becomes large. The permanent magnets 25 may be omitted.

Thus, the ignition coil including the high performance center core 4, which is relatively inexpensive, can be produced in the structure of this example embodiment.

Tenth Embodiment

Figure 17:
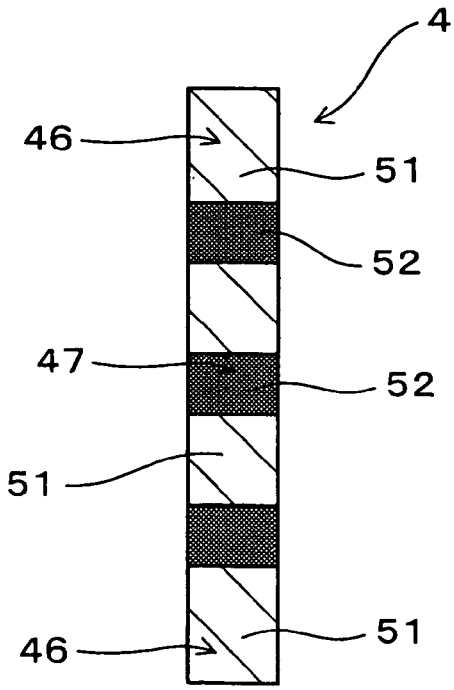
FIG. 17 is a cross sectional side view showing a center core of the ignition coil, according to a tenth embodiment of the present invention.
Figure 18:
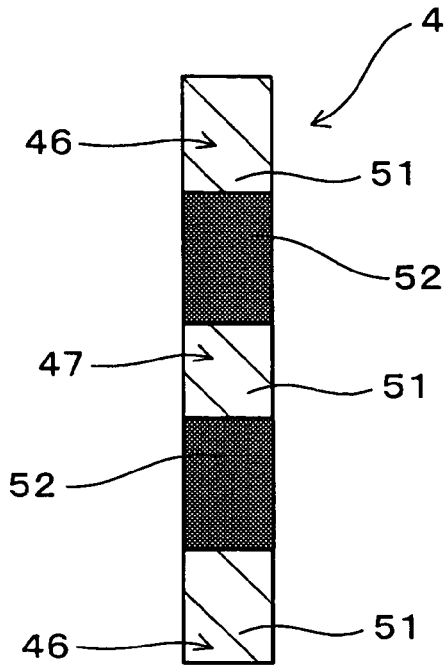
FIG. 18 is a cross sectional side view showing another center core of the ignition coil, according to the tenth embodiment.

As shown in FIGS. 17, 18, the center core 4 in this example embodiment has a modified structure of the ninth embodiment.

The center portion 47 is axially divided into multiple pieces in the center core 4. In this example structure, the first soft magnetic material 51 and the second soft magnetic material 52 are alternately arranged. The end portions 46 of the center core 4 are formed of the first soft magnetic material 51.

Structures of the ignition coil 1 other than the above construction in this example embodiment are substantially similar to the structures in the ninth embodiment, in general. Effects similar to those in the ninth embodiment can be produced by the structure of this example embodiment.

Eleventh Embodiment

Figure 19:
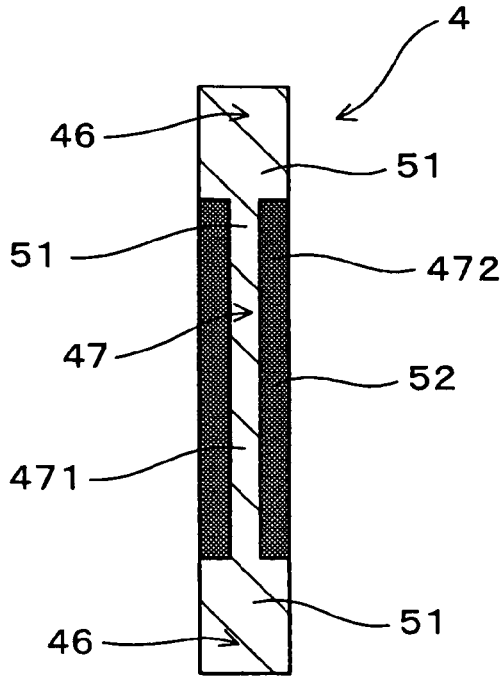
FIG. 19 is a cross sectional side view showing a center core of the ignition coil, according to an eleventh embodiment of the present invention.
Figure 20:
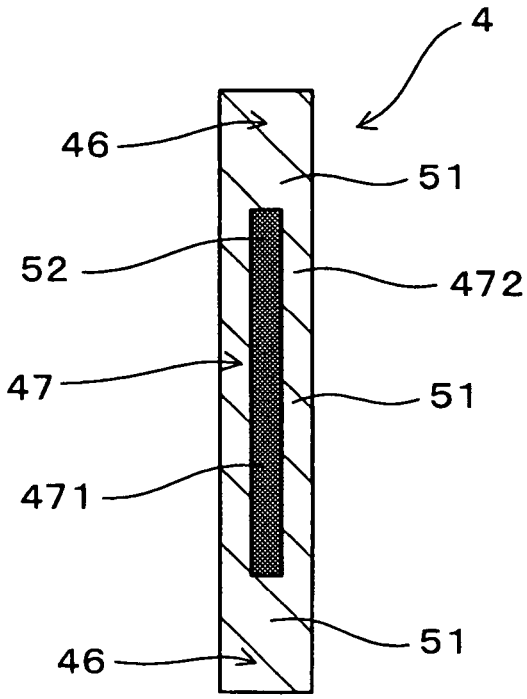
FIG. 20 is a cross sectional side view showing another center core of the ignition coil, according to the eleventh embodiment.

As shown in FIGS. 19, 20, the center core 4 in this example embodiment has a modified structure of the ninth embodiment.

The center portion 47 is radially divided into multiple pieces in the center core 4. In this structure, the center portion 47 is at least partially formed of the second soft magnetic material 52, and the portion of the center portion 47 other than the second soft magnetic material 52 is formed of the first soft magnetic material 51.

In the structure shown in FIG. 19, the center portion 47 of the center core 4 has a radial center portion 471, which is formed of the first soft magnetic material 51, and a radial outer portion 472, which is formed of the second soft magnetic material 52.

In the structure shown in FIG. 20, the center portion 47 of the center core 4 has the radial center portion 471, which is formed of the second soft magnetic material 52, and the radial outer portion 472, which is formed of the first soft magnetic material 51.

Structures of the ignition coil 1 other than the above construction in this example embodiment are substantially similar to the structures in the ninth embodiment, in general. Effects similar to those in the ninth embodiment can be produced by the structure of this example embodiment.

Twelfth Embodiment

Figure 21:
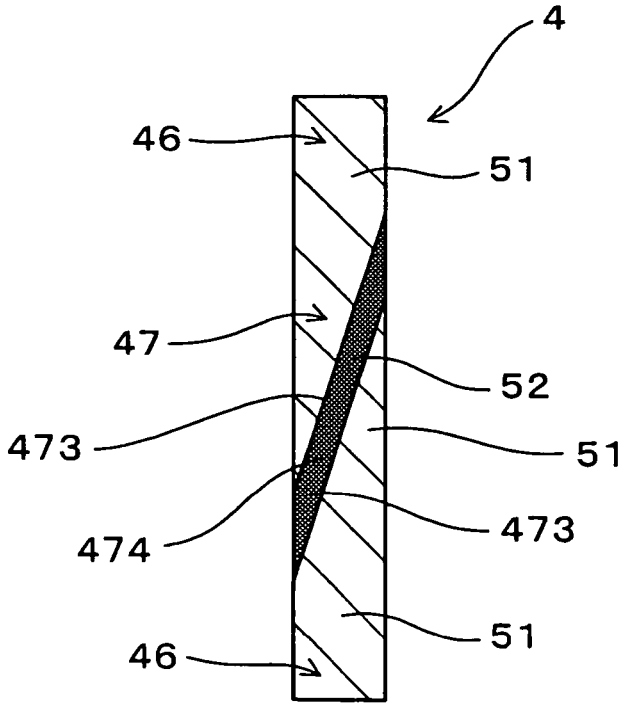
FIG. 21 is a cross sectional side view showing another center core of the ignition coil, according to a twelfth embodiment of the present invention.

As shown in FIG. 21, the center core 4 in this example embodiment has a modified structure of the ninth embodiment.

The center portion 47 has a slant portion 474 that is partitioned by two slant surfaces 473. Each of the two slant surfaces 473 is slanted with respect to the axial direction of the center core 4. The slant portion 474 is formed of the second soft magnetic material 52, and the portion of the center portion 47 other than the slant portion 474 is formed of the first soft magnetic material 51.

Structures of the ignition coil 1 other than the above construction in this example embodiment are substantially similar to the structures in the ninth embodiment, in general. Effects similar to those in the ninth embodiment can be produced by the structure of this example embodiment.

Thirteenth Embodiment

Figure 22:
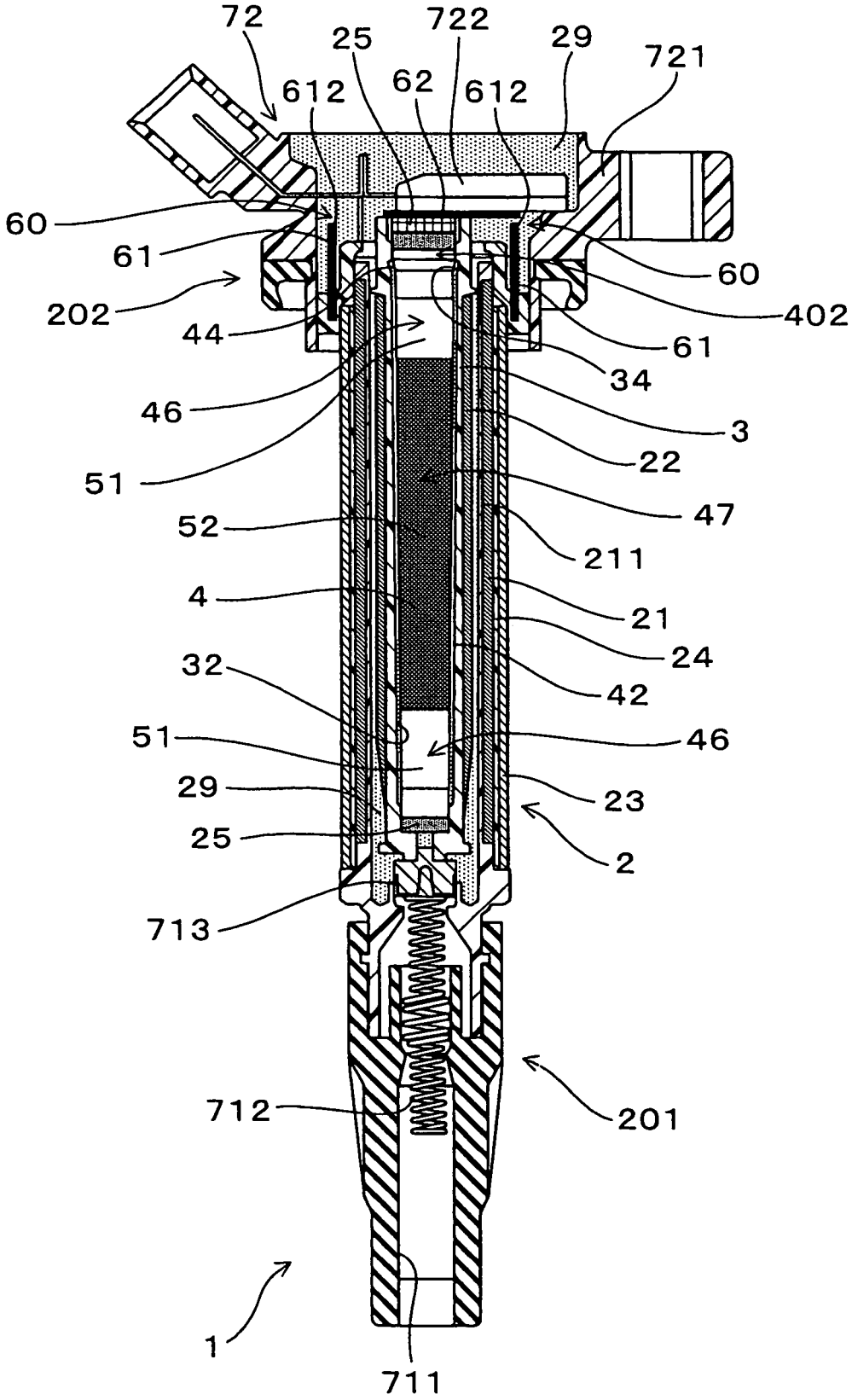
FIG. 22 is a partially cross sectional side view showing an ignition coil, according to a thirteenth embodiment of the present invention.
Figure 23:
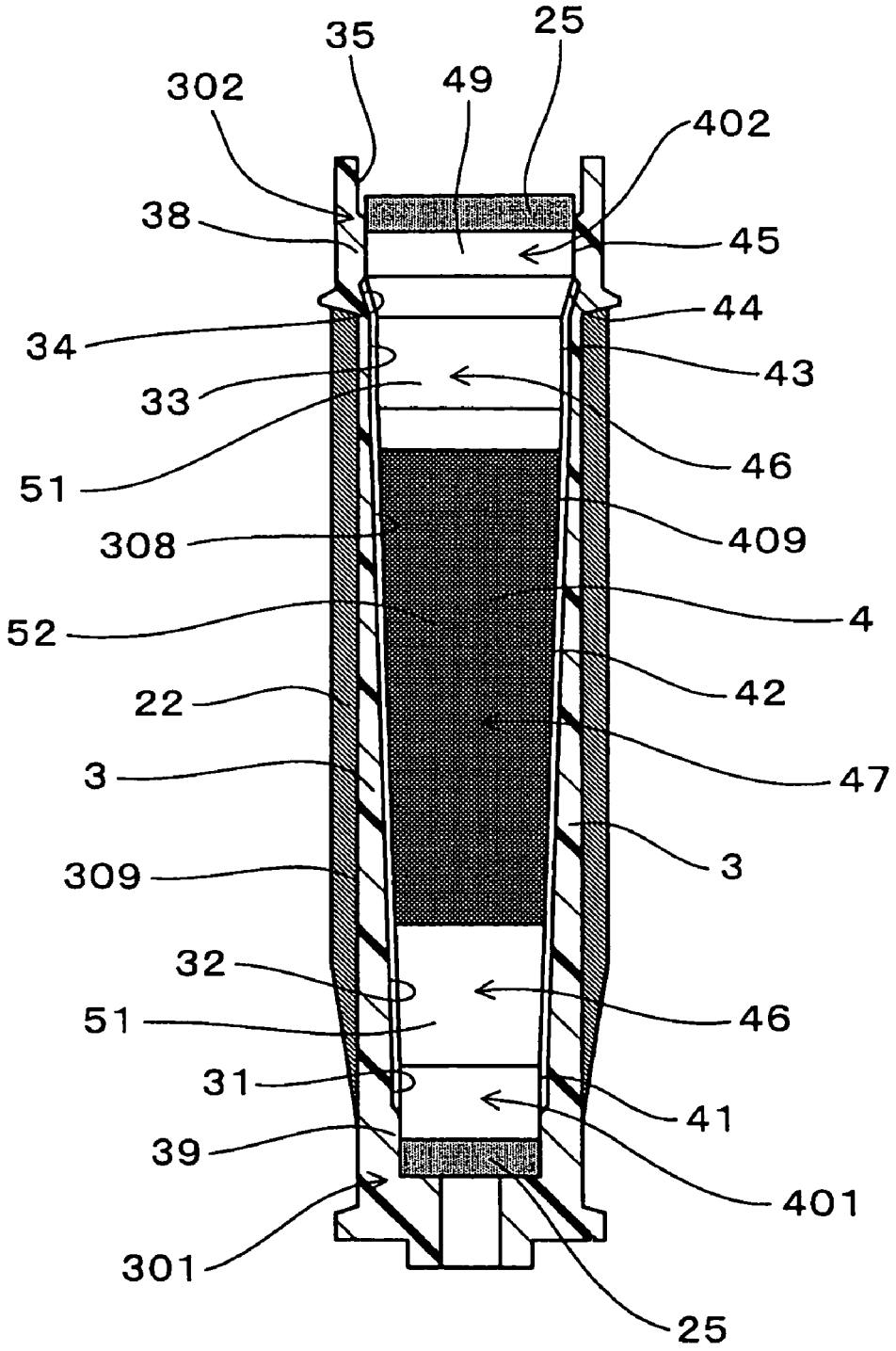
FIG. 23 is a partially cross sectional side view showing a secondary spool and a center core of the ignition coil, according to the thirteenth embodiment.

In this example embodiment, as shown in FIGS. 22, 23, the side plate 61 and the upper plate 62 are provided to the rear end 202 of the cylindrical portion 2 of the ignition coil 1, which has a partially modified structure of the ignition coil 1 and the center core 4, in the ninth embodiment.

Referring to FIG. 22, the secondary coil 22 is inserted into the inside of the primary coil 21 of the ignition coil 1. The center core 4 formed of a dust core is inserted into the inside of the secondary coil 22. The primary coil 21 is inserted into the inside of the thin walled cylinder 24, which is formed of resin to be in a substantially cylindrical shape. The outer core 23 formed of metal to be in a substantially cylindrical shape is arranged on the outer circumferential surface of the thin walled cylinder 24. The electrically insulative resin 29 is filled in all the gap between the center core 4 and the secondary coil 22, the gap between the secondary coil 22 and the primary coil 21, and the gap between the primary coil 21 and the thin walled cylinder 24.

The rear end portion 202 of the cylindrical portion 2 has the non-lapping region 60, in which the rear end 402 of the center core 4 is arranged on the axially rear side with respect to the outer core 23. The center core 4 and the outer core 23 do not radially overlap in the non-lapping region 60. The side plate 61 is provided in the non-lapping region 60. The side plate 61 is formed of a soft magnetic material to be in a substantially cylindrical shape. The side plate 61 partially covers the non-lapping region 60 on the circumferentially outer side thereof.

The upper plate 62 is provided to the rear end portion 202 of the cylindrical portion 2. The upper plate 62 is formed of a soft magnetic material to be in a substantially flat plate shape. The upper plate 62 is opposed to the axial rear end 612 of the side plate 61 and the rear end 402 of the center core 4.

Referring to FIG. 23, the secondary spool 3 has the first and second tapered inner surfaces 32, 34. Each of the first and second tapered inner surfaces 32, 34 has the diameter that increases as being distant from the tip end 201 (FIG. 22) of the cylindrical portion 2, i.e., as being distant from the tip end 301 of the secondary spool 3. The secondary spool 3 further has the first, second, and third straight inner surfaces 31, 33, 35. Each of the first, second, and third straight inner surfaces 31, 33, 35 has the inner diameter, which is substantially constant with respect to the axial direction thereof. The first straight inner surface 31, the first tapered inner surface 32, the second straight inner surface 33, the second tapered inner surface 34, and the third straight inner surface 35 are arranged in this order from the side of the tip end 301 of the secondary spool 3.

The secondary spool 3 has the rear end 302 having the first contact inner surface 38, with which the large diameter portion 49 of the center core 4 makes contact, so that the center axis of the center core 4 can be adjusted. The tip end 301 of the secondary spool 3 has the second contact inner surface 39, with which the first straight outer surface 41 of the center core 4 makes contact, so that the center axis of the center core 4 can be adjusted.

The center core 4 has the first and second tapered outer surfaces 42, 44. Each of the first and second tapered outer surfaces 42, 44 has the diameter that increases as being distant from the tip end 201 (FIG. 22) of the cylindrical portion 2, i.e., as being distant from the tip end 401 of the center core 4. The center core 4 further has the first, second, and third straight outer surfaces 41, 43, 45. Each of the first, second, and third straight outer surfaces 41, 43, 45 has the outer diameter, which is substantially constant with respect to the axial direction thereof. The first straight outer surface 41, the first tapered outer surface 42, the second straight outer surface 43, the second tapered outer surface 44, and the third straight outer surface 45 are arranged in this order from the side of the tip end 401 of the center core 4.

The center core 4 has the rear end 402, which has the large diameter portion 49 having the largest diameter of the center core 4. In this example embodiment, the third straight outer surface 45 defines the large diameter portion 49. The large diameter portion 49 is arranged on the side of the rear end with respect to the winding region, in which the secondary coil 22 is wound around the secondary spool 3. The center core 4 has the axial ends, to which the permanent magnets 25 are provided.

Referring to FIG. 23, the center core 4 is arranged on the side of the inner circumferential surface of the secondary spool 3. The center core 4 has the outer circumferential surface 409, which is defined substantially along the inner circumferential surface 308 of the secondary spool 3. That is, the inner circumferential surfaces of the secondary spool 3 and the outer circumferential surfaces of the center core 4 substantially oppose each other. Specifically, the first straight inner surface 31 and the first straight outer surface 41, and the first tapered inner surface 32 and the first tapered outer surface 42 substantially oppose each other. The second straight inner surface 33 and the second straight outer surface 43, the second tapered inner surface 34 and the second tapered outer surface 44, and the third straight inner surface 35 and the third straight outer surface 45 substantially oppose each other.

The large diameter portion 49 of the center core 4 makes contact with the first contact inner surface 38 of the secondary spool 3 via the third straight outer surface 45. In addition, the first straight outer surface 41 makes contact with the second contact inner surface 39 of the secondary spool 3. In this structure, the center axis of the center core 4 can be adjusted.

Referring to FIGS. 22, 23, structures of the ignition coil 1 other than the above construction in this example embodiment are substantially similar to the structures in the ninth embodiment, in general. The center core 4 includes the end portions 46. Each of the end portions 46 occupies 15% or greater of the corresponding axial end of the center core 4. The end portions 46 are formed of the first soft magnetic material 51. The center core 4 excluding the end portions 46 construct the center portion 47, which is formed of the second soft magnetic material 52. The second soft magnetic material 52 has a saturation magnetic flux density, which is greater than that of the first soft magnetic material 51.

In the structure of this example embodiment, the side plate 61 and the upper plate 62 are provided to the ignition coil 1, so that leakage of magnetic flux can be significantly reduced in the rear end 202 of the cylindrical portion 2 including the non-lapping region 60. Thus, magnetic flux generated in the primary coil 21 is capable of efficiently passing through the magnetic circuit constructed of the side plate 61 and the upper plate 62, in addition to the center core 4, the outer core 23, and the permanent magnets 25. Consequently, output power and performance of the ignition coil 1 can be enhanced.

In a conventional structure, the secondary spool 3 has the tapered inner surfaces 32, 34, which are formed as a matter of convenience in a forming process of the secondary spool 3. In addition, a conventional center core 4 has the diameter that is substantially constant with respect to the axial direction thereof. Accordingly, in this conventional structure, the tapered inner surfaces 32, 34 of the secondary spool 3 and the center core 4 form a redundant gap therebetween. This redundant gap becomes large, as being distant from the tip end 301 of the secondary spool 3.

However, in this example embodiment, the tapered outer surfaces 42, 44 are arranged in this conventional redundant gap. Therefore, the outer diameter of the center core 4 increases, and the cross sectional area of the center core 4 increases in this portion corresponding to the conventional gap. In this structure, the dimension of the ignition coil does not necessarily become large, compared with the conventional structure.

Therefore, the amount of magnetic flux, which is generated in the primary coil 21, passing through the center core 4 can be increased. Consequently, output power and performance of the ignition coil 1 can be enhanced, without changing the outer dimension thereof, in general. That is, the ignition coil 1 can be downsized, while maintaining the performance.

The rear end 402 of the center core 4 has the large diameter portion 49, which has the diameter largest of the center core 4. Leakage of magnetic flux, which passes through the center core 4, is apt to become large in the rear end 402 of the center core 4, in general. In the structure of this example embodiment, the large diameter portion 49 is arranged in the rear end 402, so that leakage of magnetic flux can be significantly reduced. In addition, magnetic flux, which passes through the center core 4, can be enhanced.

The large diameter portion 49 is arranged on the side of the rear end with respect to the winding region, in which the secondary coil 22 is wound around the secondary spool 3. In this structure, the diameter of the large diameter portion 49 can be further increased, so that magnetic flux, which passes through the center core 4, can be further enhanced.

The secondary spool 3 has the rear end 302 having the first contact inner surface 38, with which the large diameter portion 49 of the center core 4 makes contact, so that the center axis of the center core 4 can be adjusted. The tip end 301 of the secondary spool 3 has the second contact inner surface 39, with which the first straight outer surface 41 of the tip end 401 the center core 4 makes contact, so that the center axis of the center core 4 can be adjusted. In this structure, misalignment of the center axis of the center core 4 can be sufficiently restricted in an actual application of the ignition coil 1. In addition, the center core 4 can be readily assembled to the inside of the secondary spool 3.

In this example embodiment, the permanent magnet 25, which is arranged on the axially rear end side of the center core 4, and the large diameter portion 49 have substantially the same diameter. Therefore, the effects described above can be further enhanced, as the outer diameter of the permanent magnet 25 becomes large, so that the effect produced by the reverse bias can be further enhanced.

In this example embodiment, the above effects are added to the effects of the ninth embodiment. Specifically, the center portion 47 is formed of the soft magnetic material, which has the saturation magnetic flux density greater than that of the soft magnetic material of the end portions 46. When the primary coil 21 generates magnetic flux, magnetic flux density becomes high in the center portion 47, so that leakage of magnetic flux becomes small in the center portion 47. Therefore, magnetic flux passing through the center core 4 can be efficiently enhanced, in addition to the above effects of this example embodiment. Thus, output power and performance of the ignition coil 1 can be enhanced in the structure.

Fourteenth Embodiment

Figure 24:
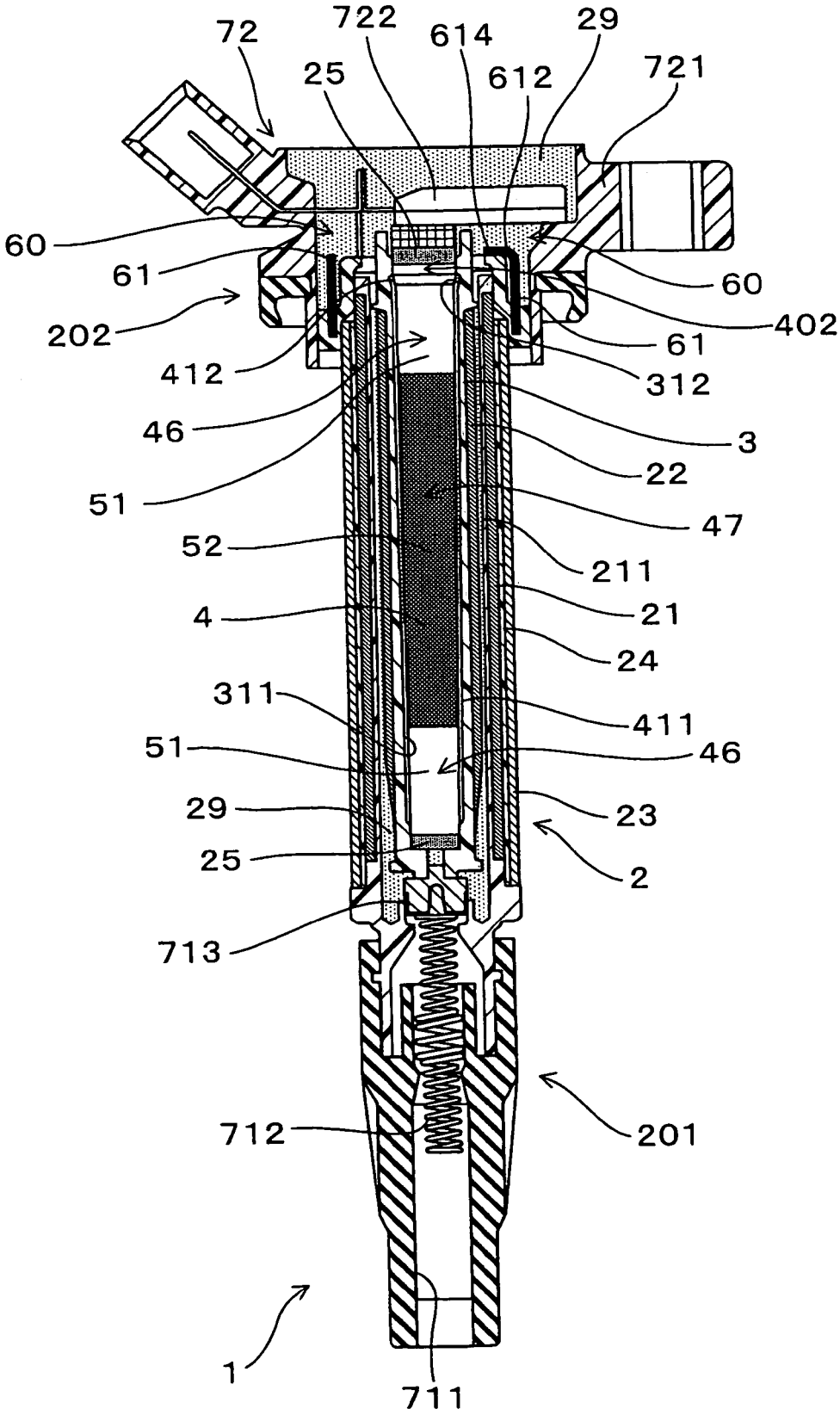
FIG. 24 is a partially cross sectional side view showing an ignition coil, according to a fourteenth embodiment of the present invention.
Figure 25:
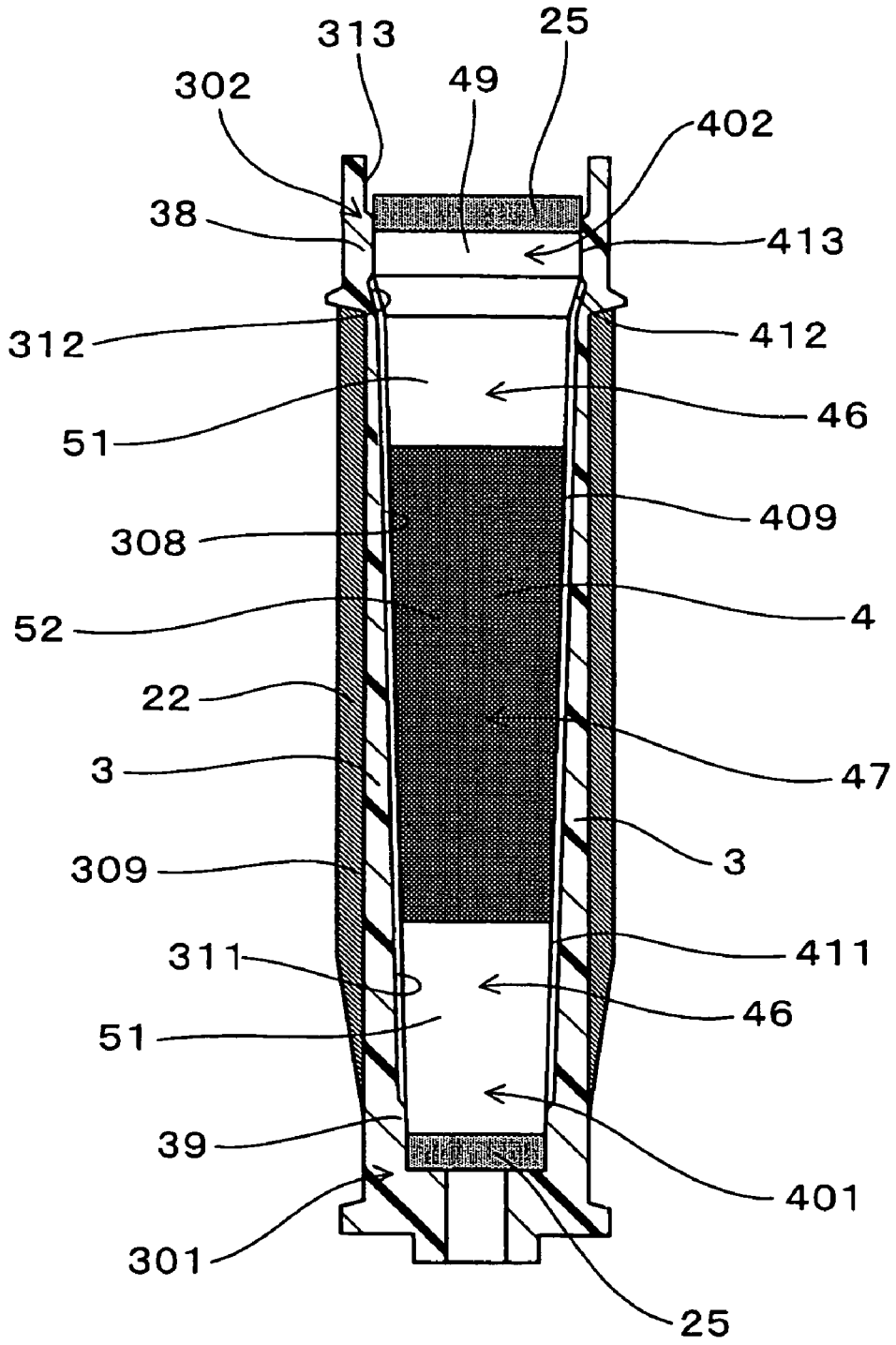
FIG. 25 is a partially cross sectional side view showing a secondary spool and a center core of the ignition coil, according to the fourteenth embodiment.

As shown in FIG. 24 and FIG. 25, in this example embodiment, the shapes of the secondary spool 3, the center core 4, and the side plate 61 are modified compared with the ignition coil 1 of the thirteenth embodiment. In addition, the upper plate 62 is omitted from the ignition coil 1 of the thirteenth embodiment.

Referring to FIG. 24, the side plate 61 is arranged in the non-lapping region 60 formed in the rear end 202 of the cylindrical portion 2. The side plate 61 is formed of a soft magnetic material to be in a substantially cylindrical shape. This side plate 61 has the bent end 614, which is bent at least partially from the axial rear end 612 to the inside. The bent end 614 has the inner circumferential end, which is opposed to the side surface of the permanent magnet 25 provided to the rear end 402 of the center core 4. When the permanent magnet 25 is not provided, the inner circumferential surface of the bent end 614 is opposed to the side surface of the center core 4.

Referring to FIG. 25, the secondary spool 3 has the first and second tapered inner surfaces 311, 312. Each of the first and second tapered inner surfaces 311, 312 has the diameter that increases as being distant from the tip end 301 of the secondary spool 3. The secondary spool 3 further has the straight inner surface 313, which has the inner diameter substantially constant with respect to the axial direction thereof. The first tapered inner surface 311, the second tapered inner surface 312, and the straight inner surface 313 are arranged in this order from the side of the tip end 301 of the secondary spool 3.

The center core 4 has the first and second tapered outer surfaces 411, 412. Each of the first and second tapered outer surfaces 411, 412 has the diameter that increases as being distant from the tip end 401 of the center core 4.

The center core 4 further has the straight outer surface 413, which has the outer diameter substantially constant with respect to the axial direction thereof. The first tapered outer surface 411, the second tapered outer surface 412, and the straight outer surface 413 are arranged in this order from the side of the tip end 401 of the center core 4.

The center core 4 has the outer circumferential surface 409, which is defined substantially along the inner circumferential surface 308 of the secondary spool 3, similarly to the structure in the ninth embodiment. That is, the inner circumferential surfaces of the secondary spool 3 and the outer circumferential surfaces of the center core 4 substantially oppose each other. Specifically, the first tapered inner surface 311 and the first tapered outer surface 411 substantially oppose each other. The second tapered inner surface 312 and the second tapered outer surface 412, and the straight inner surface 313 and the straight outer surface 413 substantially oppose each other.

Structures of the ignition coil 1 other than the above construction in this example embodiment are substantially similar to the structures in the thirteenth embodiment, in general.

In the structure of this example embodiment, the bent end 614 of the side plate 61 has a function similar to that of the upper plate 62 in the thirteenth embodiment. Therefore, leakage of magnetic flux becomes small in the rear end 202 of the cylindrical portion 2, similarly to the structure, in which the upper plate 62 is provided, so that magnetic flux passing through the magnetic circuit can be efficiently enhanced.

In this example embodiment, the tapered outer surfaces 411, 412 of the center core 4 are arranged in the conventional redundant gap between the tapered inner surfaces 311, 312 of the secondary spool 3 and the center core 4. Therefore, the cross sectional area of the center core 4 increases in this portion corresponding to the conventional gap, so that the amount of magnetic flux passing through the center core 4 can be increased, without changing the outer dimension of the ignition coil 1, in general.

Structures of the ignition coil 1 other than the above construction in this example embodiment are substantially similar to the structures in the thirteenth embodiment, in general. Consequently, output power and performance of the ignition coil 1 can be further enhanced.

Fifteenth Embodiment

Figure 26:
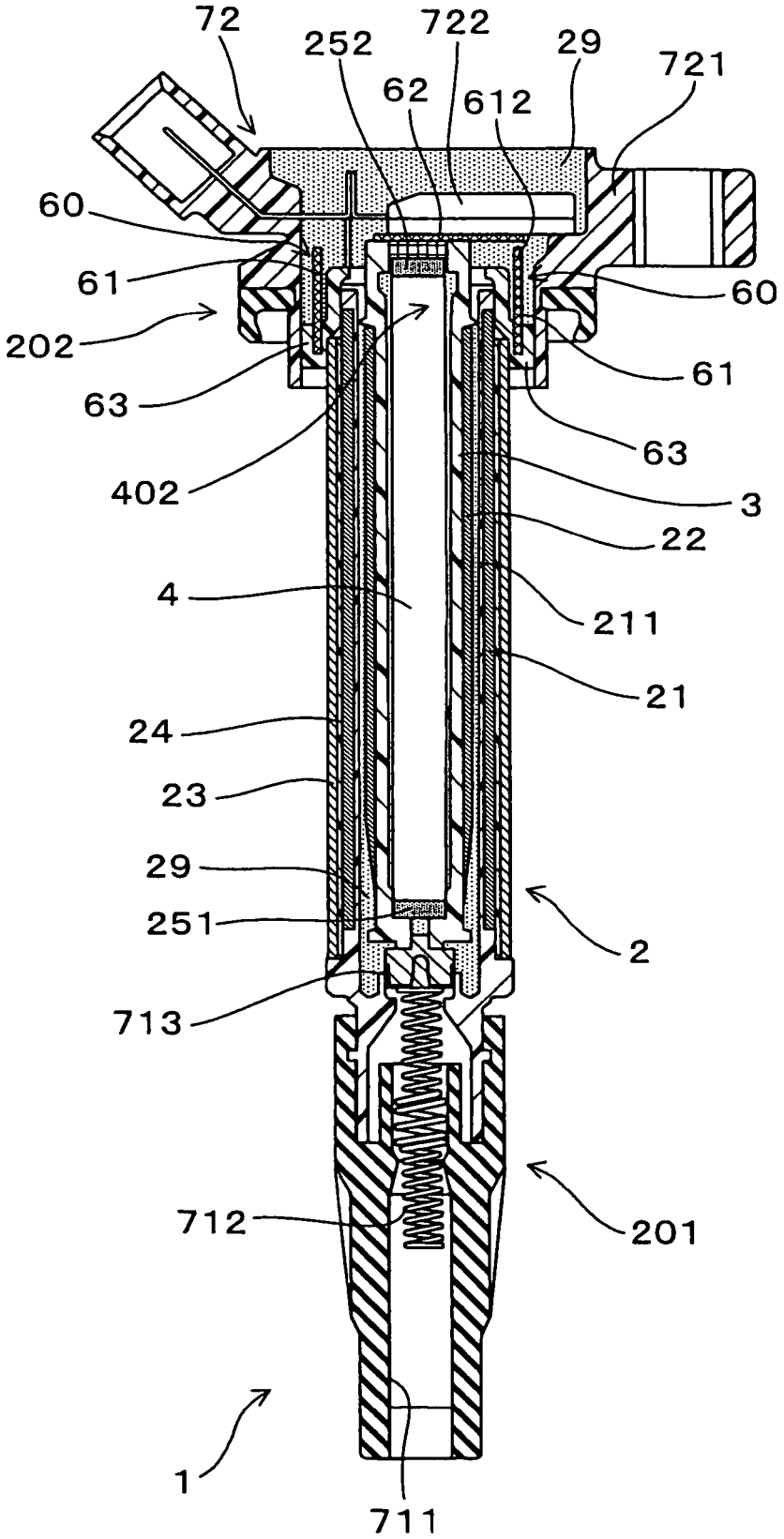
FIG. 26 is a partially cross sectional side view showing an ignition coil, according to a fifteenth embodiment of the present invention.

As shown in FIG. 26, the ignition coil 1 includes the cylindrical portion 2 that accommodates the primary coil 21, the secondary coil 22, the center core 4, and the outer core 23, which are coaxially arranged. The center core 4 is arranged on the circumferentially inner side of the secondary coil 22. The outer core 23 is arranged on the circumferentially outer side of the primary coil 21. The cylindrical portion 2 has the tip end 201, on which the plug holder 711 is formed. The plug holder 711 is to be connected with a spark plug.

The rear end portion 202 of the cylindrical portion 2 has the non-lapping region 60, in which the rear end 402 of the center core 4 is arranged on the axially rear side with respect to the outer core 23. The center core 4 and the outer core 23 do not radially overlap in the non-lapping region 60. The side plate 61, which is formed of a soft magnetic material, is provided in the non-lapping region 60. The side plate 61 at least partially covers the non-lapping region 60 on the circumferentially outer side thereof.

As shown in FIG. 26 in this example embodiment, the primary coil 21 is constructed of an electrically insulative wire, which is wound around the outer circumferential surface of the primary spool 211. The primary spool 211 is formed of resin to be in a substantially cylindrical shape. The secondary coil 22 is constructed of an electrically insulative wire, which is wound around the outer circumferential surface of the secondary spool 3. The secondary spool 3 is formed of resin to be in a substantially cylindrical shape. The wire of the secondary coil 22 is wound for a winding number, which is greater than a winding number of the primary coil 21. Alternatively, the primary coil 21 may be formed by winding an electrically insulative wire to be in a substantially cylindrical shape, and joining the wire using a fusion material or the like.

The secondary coil 22 is inserted into the inner circumferential side of the primary coil 21. The center core 4 is arranged inside of the inner circumferential side of the secondary core 22. The center core 4 is formed of metal to be in a substantially column shape. The primary coil 21 is inserted into the inside of the thin walled cylinder 24, which is formed of resin to be in a substantially cylindrical shape. The outer core 23 formed of metal to be in a substantially cylindrical shape is arranged on the outer circumferential surface of the thin walled cylinder 24. The electrically insulative resin 29 is filled in all the gap between the center core 4 and the secondary coil 22, the gap between the secondary coil 22 and the primary coil 21, and the gap between the primary coil 21 and the thin walled cylinder 24. The electrically insulative resin 29 is epoxy resin in this example embodiment.

The center core 4 is formed of dust core, which is shaped by compressing powder of a soft magnetic material, for example. Specifically, the center core 4 can be formed by filling powder of a soft magnetic material into a die, and hot pressing the powder, for example. The soft magnetic material may be composed mainly of iron. The shape of the outer surface of the dust core can be freely defined by the surface of the die. Therefore, it is advantageous to form the center core 4 of a dust core, when the shape of the outer circumferential surface is complicated in the structure of the center core 4.

The center core 4 may be constructed by stacking multiple silicon steel plates, which are coated to be electrically insulative, in the radial direction of the center core 4, instead of using the dust core. In this structure, eddy current, which is caused by magnetic field generated using the primary coil 21, can be restricted from arising.

The center core 4 has the axial ends, to which permanent magnets 251, 252 are provided. The permanent magnets 251, 252 are arranged such that each of the permanent magnets 251, 252 generates magnetic flux in a direction opposite to the direction of magnetic flux generated using the primary coil 21.

The rear end portion 202 of the cylindrical portion 2 has the non-lapping region 60, in which the rear end 402 of the center core 4 is arranged on the axially rear side with respect to the outer core 23. The center core 4 and the outer core 23 do not radially overlap in the non-lapping region 60. The side plate 61 is provided in the non-lapping region 60. The side plate 61 is formed of a soft magnetic material to be in a substantially cylindrical shape. The side plate 61 at least partially covers the non-lapping region 60 on the circumferentially outer side thereof.

The upper plate 62 is provided to the rear end portion 202 of the cylindrical portion 2. The upper plate 62 is formed of a soft magnetic material to be in a substantially flat plate shape. The upper plate 62 is opposed to the axial rear end 612 of the side plate 61 and the rear end 402 of the center core 4.

Figure 27:
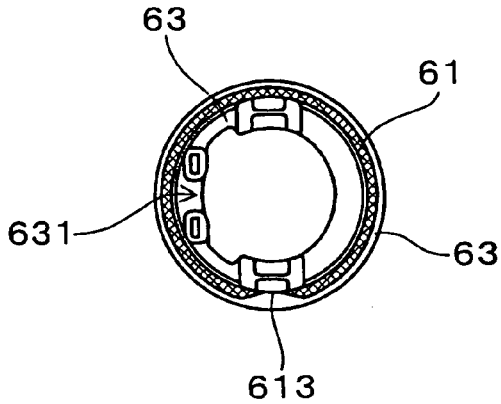
FIG. 27 is a top view showing a side plate and a resinous member in the ignition coil, according to the fifteenth embodiment.

As shown in FIG. 27, the side plate 61 is formed integrally with a fixing resinous member 63, which is formed of resin to partially cover the side plate 61. The side plate 61 has a slit 613 with respect to the axial direction thereof for restricting eddy current from airing therein. The fixing resinous member 63 has a terminal fixing portion 631, to which a terminal of the wire, which is wound to form the primary coil 21, is electrically connected. The side plate 61 is aligned and fixed by engaging the fixing resinous member 63 with the outer core 23. FIG. 27 is a view showing the fixing resinous member 63 and the side plate 61 when being viewed from the axially rear end side thereof. The side plate 61 is integrally formed with the fixing resinous member 63, for example.

Figure 28:
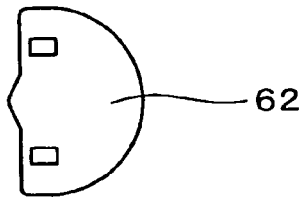
FIG. 28 is a top view showing an upper plate of the ignition coil, according to the fifteenth embodiment.

As shown in FIG. 28, the upper plate 62 has a substantially semicircle shape when being viewed from the upper side in FIG. 26.

Figure 29:
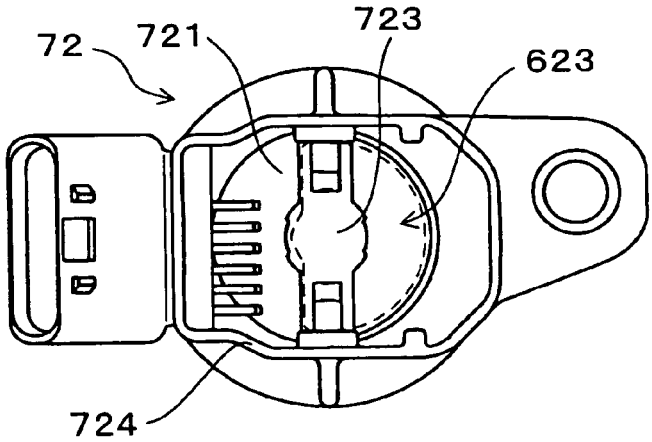
FIG. 29 is a top view showing an igniter case receiving the upper plate of the ignition coil, according to the fifteenth embodiment.

As shown in FIG. 29, the igniter portion 72 has a positioning portion 723, which is for positioning the igniter 722 (FIG. 26) and the secondary coil 22. The upper plate 62 is provided to an upper plate mounting portion 623, which covers the positioning portion 723. The igniter 722 is arranged on the upper plate 62. FIG. 29 is a view showing the igniter portion 72, which is before being attached with the igniter 722, when being viewed from the axially rear end side thereof.

Magnetic flux generated by energizing the primary coil 21 is capable of passing through the magnetic circuit constructed of the center core 4, the outer core 23, the permanent magnets 251, 252, the side plate 61, and the upper plate 62. Consequently, output power and performance of the ignition coil 1 can be enhanced. In this example embodiment, magnetic flux generated by the primary coil 21 passes through the center core 4, the permanent magnet 252, the upper plate 62, the side plate 61, the outer core 23, the permanent magnet 251, and the center core 4, in this order.

Referring to FIG. 26 and FIG. 29, the cylindrical portion 2 has the rear end 202 having the igniter portion 72. The igniter 722 for supplying electric power to the primary coil 21 is fixed to an igniter fixing portion 724 in the igniter case 721. The igniter case 721 is filled with the electrically insulative resin 29 therein, in a condition where the igniter 722 is arranged in the igniter case 721. The igniter 722 includes an electric power control circuit, an ion electricity detecting circuit, and the like. The electric power control circuit includes a switching element, which is operated by a signal transmitted from the ECU, and the like. The ion electricity detecting circuit detects ion electricity.

Referring to FIG. 26, the tip end 201 of the cylindrical portion 2 has the plug holder 711, to which a spark plug is to be attached. The plug holder 711 has a coil spring 712, which makes contact with the spark plug. The coil spring 712 is electrically connected with an end of the winding of the secondary coil 22 on the high voltage side via the high voltage terminal 713.

The switching element and the like are operated when an ignition timing signal is transmitted from the ECU to the igniter 722 in the ignition coil 1.

The switching element of the igniter 722 instantaneously supplies electricity to the primary coil 21, and stops supplying the electricity, so that the primary coil 21 generates magnetic flux passing through the center core 4, the outer core 23, and the permanent magnets 25. This magnetic flux causes an interlinkage with respect to the secondary coil 22, so that the secondary coil 22 generates induced electromotive force by electromagnetic induction. Thus, the sparkplug attached to the plug holder 711 of the ignition coil 1 generates spark.

As follows, effects of the ignition coil in this example embodiment are described.

In the structure of this example embodiment, the side plate 61, which is formed of a soft magnetic material, covers the non-lapping region 60 from the circumferentially outer side thereof. The non-lapping region 60 is formed in the rear end 202 of the cylindrical portion 2. Therefore, magnetic resistance of the non-lapping region 60 can be reduced using the side plate 61, so that magnetic flux generated by supplying electricity to the primary coil 21 is capable of smoothly passing through the non-lapping region 60. Thus, magnetic flux can be restricted from leaking in the rear end 202 of the cylindrical portion 2.

Magnetic flux generated in the primary coil 21 is capable of efficiently passing through the magnetic circuit including the center core 4, the outer core 23, and the side plate 61. Thus, leakage of magnetic flux can be significantly reduced, so that electromotive force generated in the secondary coil 22 by being induced using the magnetic flux can be significantly enhanced, and degree of spark generated in the spark plug can be increased.

In this example embodiment, the upper plate 62, which is formed of soft magnetic material, is provided to the rear end 202 of the cylindrical portion 2, such that the upper plate 62 opposes at least in part of the axial rear end 612 of the side plate 61 and the rear end 402 of the center core 4. Thus, leakage of magnetic flux can be significantly reduced using the upper plate 62, in addition to the side plate 61. Thus, magnetic flux generated in the primary coil 21 is capable of efficiently passing through the magnetic circuit including the upper plate 62, so that magnetic flux can be further restricted from leaking.

Furthermore, the side plate 61 has the slit 613 substantially along the axial direction of the center core 4, so that the side plate 61 is capable of restricting from causing eddy current therein. Thus, induced electromotive force generated in the secondary coil 22 can be further enhanced.

The side plate 61 is formed integrally with the fixing resinous member 63, which covers at least in part of the side plate 61. The fixing resinous member 63 engages with the outer core 23, so that the side plate 61 is secured. Thus, the side plate 61 can be readily positioned and fixed.

The side plate 61 need not be formed integrally with the fixing resinous member 63. The side plate 61 may be press-inserted into the fixing resinous member 63, which is formed individually from the side plate 61.

The center core 4 has the axial ends, to which permanent magnets 251, 252 are provided. The permanent magnets 251, 252 generate magnetic flux in the direction opposite to the direction of magnetic flux generated using the primary coil 21, so that reverse bias can be applied using the magnetic flux of the permanent magnets 251, 252. Thus, induced electromotive force generated in the secondary coil 22 can be further enhanced. The effect of the reverse bias can be further enhanced, as the outer diameters of the permanent magnets 251, 252 become large. The permanent magnets 251, 252 may be omitted.

The center core 4 is formed of the dust core. Therefore, the shape of the outer surface of dust core 4 can be freely defined by modifying the surface of the die, thereby being adapted to a complicated shape.

The soft magnetic material of the dust core may be various generally known materials and materials developed in future.

As described above, in this example embodiment, the ignition coil 1, which is capable of enhancing performance and output power thereof while reducing leakage of magnetic flux, can be produced.

Sixteenth Embodiment

Figure 31:
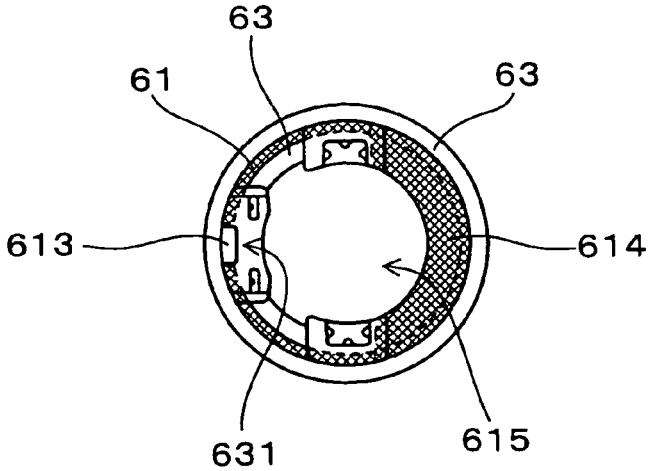
FIG. 31 is a top view showing a side plate and a resinous member in the ignition coil, according to the sixteenth embodiment.
Figure 30:
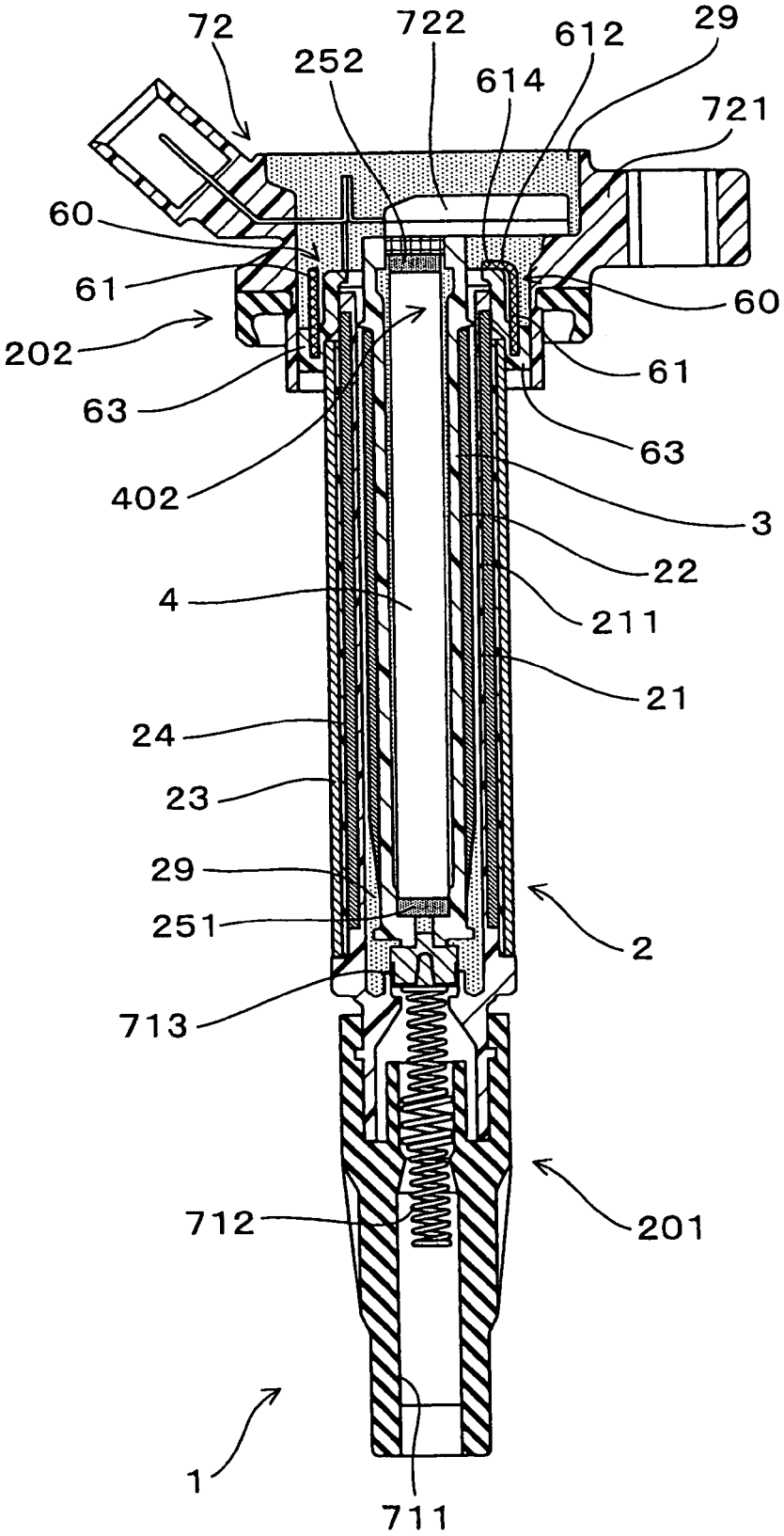
FIG. 30 is a partially cross sectional side view showing an ignition coil, according to a sixteenth embodiment of the present invention.

As shown in FIGS. 30, 31, in this example embodiment, the shape of the side plate 61 is modified compared with the ignition coil 1 of the fifteenth embodiment. In addition, the upper plate 62 is omitted from the ignition coil 1 of the fifteenth embodiment.

Referring to FIG. 30, the side plate 61 has the bent end 614. This bent end 614 is formed by bending at least in part of the axial rear end 612 to the inside.

Referring to FIG. 31, the bent end 614 of the side plate 61 covers in part of an opening 615 of the rear end of the side plate 61. The side plate 61 is formed integrally with the fixing resinous member 63, which is formed of resin to partially cover the side plate 61. The side plate 61 has the slit 613 with respect to the axial direction thereof for restricting eddy current from airing therein. FIG. 31 is the view showing the fixing resinous member 63 and the side plate 61, which is formed integrally with the fixing resinous member 63, when being viewed from the side of the axial rear end.

Referring to FIG. 30, the bent end 614 of the side plate 61 has the inner circumferential end that is opposed to the side surface of the permanent magnet 252, which is provided to the rear end 402 of the center core 4. In this example embodiment, the inner circumferential end of the bent end 614 is distant from the side surface of the permanent magnet 252 for substantially 1.5 mm.

Structures of the ignition coil 1 other than the above construction in this example embodiment are substantially similar to the structures in the fifteenth embodiment, in general.

In the structure of this example embodiment, the bent end 614 of the side plate 61 has a function similar to that of the upper plate 62 in the fifteenth embodiment. Therefore, leakage of magnetic flux becomes small in the rear end 202 of the cylindrical portion 2, similarly to the structure, in which the upper plate 62 is provided, so that magnetic flux passing through the magnetic circuit can be efficiently enhanced. Therefore, the ignition coil 1 is capable of producing performance equivalent to that of the ignition coil 1 in the fifteenth embodiment.

In this example embodiment, the inner circumferential end of the bent end 614 is distant from the side surface of the permanent magnet 252 for substantially 1.5 mm. In this structure, the permanent magnet 252 is electrically insulative sufficiently with respect to the side plate 61. Furthermore, magnetic flux is capable of smoothly passing through the gap, which is between the permanent magnet 252 and the bent end 614 of the side plate 61. In addition, magnetic flux is capable of being restricted from leaking through this gap between the permanent magnet 252 and the bent end 614.

Other effects in this example embodiment are substantially similar to the effects in the fifteenth embodiment, in general.

Seventeenth Embodiment

Figure 32:
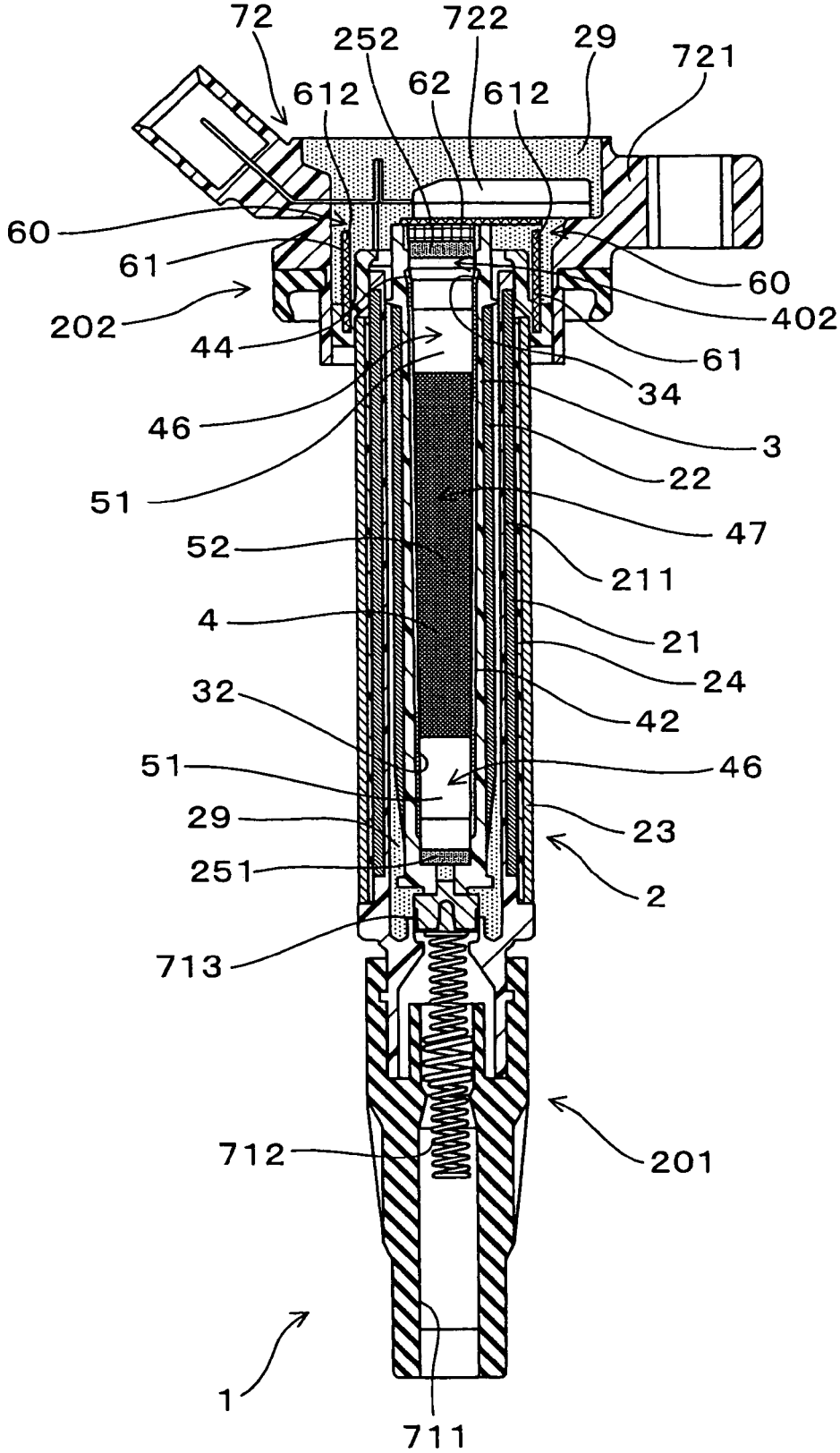
FIG. 32 is a partially cross sectional side view showing an ignition coil, according to a seventeenth embodiment of the present invention.

In this example embodiment, as shown in FIG. 32, 33, in this example embodiment, the center core 4 includes the end portions 46 respectively occupying 15% or greater in length of both the axial ends of the center core 4. The end portions 46 are formed of the first soft magnetic material 51. The center core 4 excluding the end portions 46 construct the center portion 47, which is formed of the second soft magnetic material 52. The second soft magnetic material 52 has a saturation magnetic flux density, which is greater than that of the first soft magnetic material 51. In this example embodiment, the first soft magnetic material 51 is formed of ferrous powder, which has a saturation magnetic flux density of 1.6 (T). The second soft magnetic material 52 is formed of Permendur, which has a saturation magnetic flux density of 2.3 (T). This Permendur is an alloy, which has a high magnetic flux density. The Permendur is composed of iron, which is a soft magnetic material, and cobalt. Specifically, the Permendur contains substantially 50 wt % of cobalt.

The center portion 47 of the center core 4 may be partially formed of the second soft magnetic material 52. In this structure, the location of the second soft magnetic material 52 can be variously arranged in the center core 4.

Figure 33:
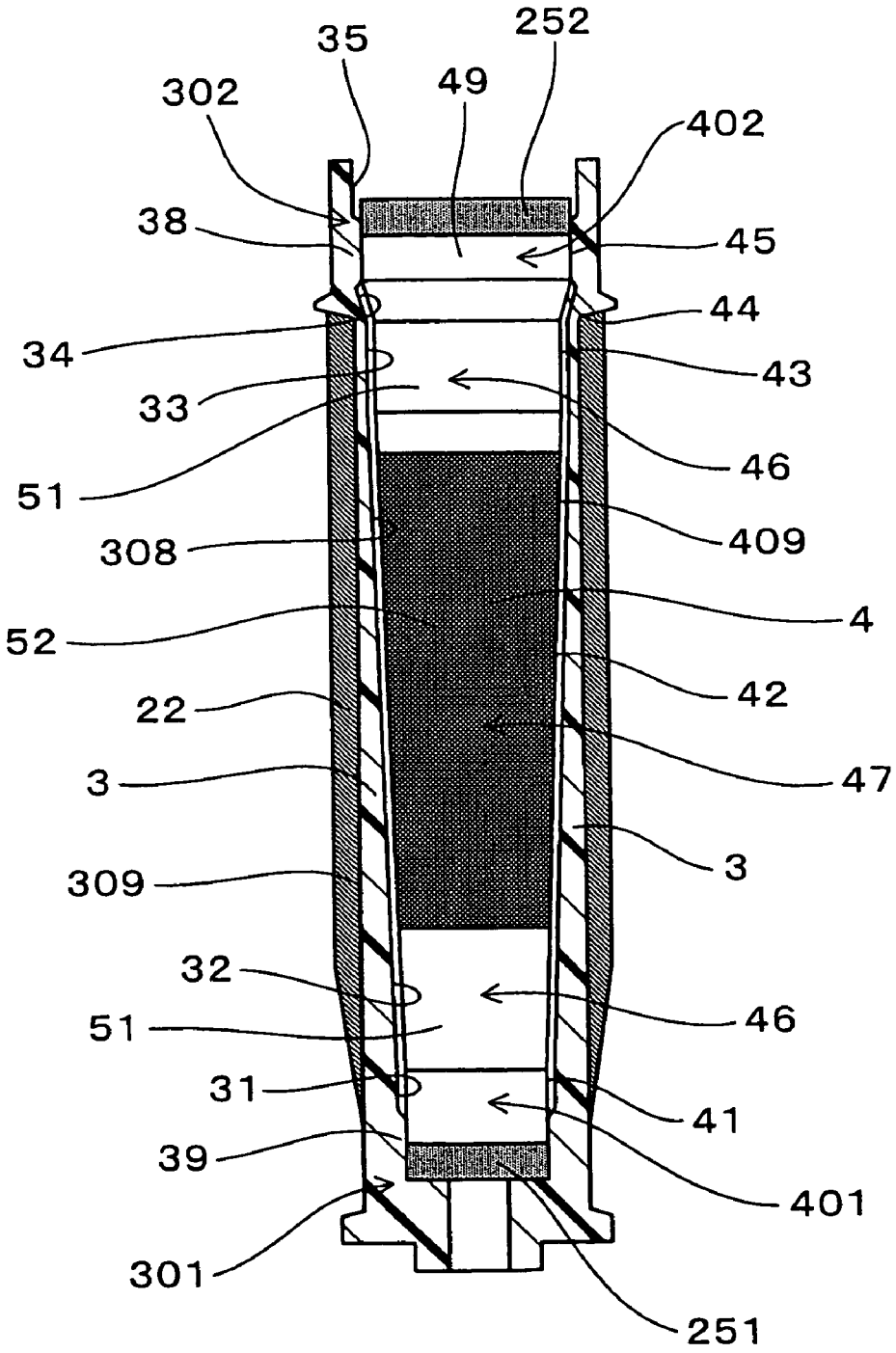
FIG. 33 is a partially cross sectional side view showing a secondary spool and a center core of the ignition coil, according to the seventeenth embodiment.

Referring to FIG. 33, the secondary spool 3 has the first and second tapered inner surfaces 32, 34. Each of the first and second tapered inner surfaces 32, 34 has the diameter that increases as being distant from the tip end 201 (FIG. 32) of the cylindrical portion 2, i.e., as being distant from the tip end 301 of the secondary spool 3. The secondary spool 3 further has the first, second, and third straight inner surfaces 31, 33, 35. Each of the first, second, and third straight inner surfaces 31, 33, 35 has the inner diameter, which is substantially constant with respect to the axial direction thereof. The first straight inner surface 31, the first tapered inner surface 32, the second straight inner surface 33, the second tapered inner surface 34, and the third straight inner surface 35 are arranged in this order from the side of the tip end 301 of the secondary spool 3.

The secondary spool 3 has the rear end 302 having the first contact inner surface 38, with which the large diameter portion 49 of the center core 4 makes contact, so that the center axis of the center core 4 can be adjusted. The tip end 301 of the secondary spool 3 has the second contact inner surface 39, with which the first straight outer surface 41 of a tip end 401 the center core 4 makes contact, so that the center axis of the center core 4 can be adjusted.

The center core 4 has the first and second tapered outer surfaces 42, 44. Each of the first and second tapered outer surfaces 42, 44 has the diameter that increases as being distant from the tip end 201 (FIG. 32) of the cylindrical portion 2, i.e., as being distant from the tip end 401 of the center core 4. The center core 4 further has the first, second, and third straight outer surfaces 41, 43, 45. Each of the first, second, and third straight outer surfaces 41, 43, 45 has the outer diameter, which is substantially constant with respect to the axial direction thereof. The first straight outer surface 41, the first tapered outer surface 42, the second straight outer surface 43, the second tapered outer surface 44, and the third straight outer surface 45 are arranged in this order from the side of the tip end 401 of the center core 4.

The center core 4 has the rear end 402, which has the large diameter portion 49 having the largest diameter of the center core 4. In this example embodiment, the third straight outer surface 45 defines the large diameter portion 49. The large diameter portion 49 is arranged on the side of the rear end with respect to the winding region, in which the secondary coil 22 is wound around the secondary spool 3. The center core 4 has the axial ends, to which the permanent magnets 251, 252 are provided.

Referring to FIG. 33, the center core 4 is arranged on the side of the inner circumferential surface of the secondary spool 3. The center core 4 has the outer circumferential surface 409, which is defined substantially along the inner circumferential surface 308 of the secondary spool 3. That is, the inner circumferential surfaces of the secondary spool 3 and the outer circumferential surfaces of the center core 4 substantially oppose each other. Specifically, the first straight inner surface 31 and the first straight outer surface 41, and the first tapered inner surface 32 and the first tapered outer surface 42 substantially oppose each other. The second straight inner surface 33 and the second straight outer surface 43, the second tapered inner surface 34 and the second tapered outer surface 44, and the third straight inner surface 35 and the third straight outer surface 45 substantially oppose each other.

The large diameter portion 49 of the center core 4 makes contact with the first contact inner surface 38 of the secondary spool 3 via the third straight outer surface 45. In addition, the first straight outer surface 41 makes contact with the second contact inner surface 39 of the secondary spool 3. In this structure, the center axis of the center core 4 can be adjusted.

Referring to FIG. 32, structures of the ignition coil 1 other than the above construction in this example embodiment are substantially similar to the structures in the fifteenth embodiment, in general. The side plate 61 covers the non-lapping region 60 from the circumferentially outer side in the rear end portion 202 of the cylindrical portion 2. The upper plate 62 is at least partially opposed to at least one of the axial rear end 612 of the side plate 61 and the rear end 402 of the center core 4.

When the primary coil 21 generates magnetic flux, magnetic flux density becomes high in the center portion 47, and leakage of magnetic flux becomes small in the center portion 47. The center portion 47, which is formed of the second soft magnetic material 52, which has the saturation magnetic flux density greater than that of the first soft magnetic material 51 used in the end portions 46 of the center core 4. Therefore, magnetic flux passing through the center core 4 can be efficiently enhanced. A material, which has a high magnetic flux density, is expensive, in general. In this structure, such an expensive material is used in a limited portion, which is needed to produce high magnetic flux density. Therefore, the structure in this example embodiment becomes inexpensive, compared with a structure, in which the center core 4 is entirely formed of a material, which has a high magnetic flux density. In addition, output power and performance of the ignition coil 1 can be enhanced in this structure.

In a conventional structure, the secondary spool 3 has the tapered inner surfaces 32, 34, which are formed as a matter of convenience in a forming process of the secondary spool 3. In addition, a conventional center core 4 has the diameter that is substantially constant with respect to the axial direction thereof. This diameter of the conventional center core 4 is substantially set at the inner diameter, which is smallest of the secondary spool 3, in general. Accordingly, in this conventional structure, the secondary spool 3 and the center core 4 form a redundant gap therebetween. This redundant gap becomes large, as being distant from the tip end 301 of the secondary spool 3.

However, in this example embodiment, the tapered outer surfaces 42, 44 are arranged to be opposing to the tapered inner surfaces 32, 34. Therefore, the tapered outer surfaces 42, 44 are arranged in this conventional redundant gap, so that the outer diameter of the center core 4 increases, and the cross sectional area of the center core 4 increases in this portion corresponding to the conventional gap. In this structure, the dimension of the ignition coil need not be necessarily enlarged, compared with the conventional structure.

Therefore, the amount of magnetic flux, which is generated in the primary coil 21, passing through the center core 4 can be increased. Consequently, output power and performance of the ignition coil 1 can be enhanced, without changing the outer dimension thereof, in general. That is, the ignition coil 1 can be downsized, while maintaining the performance.

The rear end 402 of the center core 4 has the large diameter portion 49, which has the diameter largest of the center core 4. Leakage of magnetic flux, which passes through the center core 4, is apt to become large in the rear end 402 of the center core 4, in general. In the structure of this example embodiment, the large diameter portion 49 is arranged in the rear end 402, so that leakage of magnetic flux can be significantly reduced. In addition, magnetic flux, which passes through the center core 4, can be enhanced.

The large diameter portion 49 is arranged on the side of the rear end with respect to the winding region, in which the secondary coil 22 is wound around the secondary spool 3. In this structure, the diameter of the large diameter portion 49 can be further increased, so that magnetic flux, which passes through the center core 4, can be further enhanced.

The secondary spool 3 has the rear end 302 having the first contact inner surface 38, with which the large diameter portion 49 of the center core 4 makes contact. The tip end 301 of the secondary spool 3 has the second contact inner surface 39, with which the first straight outer surface 41 of the tip end 401 the center core 4 makes contact. In this structure, misalignment of the center axis of the center core 4 can be sufficiently restricted in an actual application of the ignition coil 1. In addition, the center core 4 can be readily assembled to the inside of the secondary spool 3.

In this example embodiment, the permanent magnet 252, which is arranged on the axially rear end side of the center core 4, and the large diameter portion 49 have substantially the same diameter. Therefore, the effects described above can be further enhanced, as the outer diameter of the permanent magnet 252 becomes large, so that the effect produced by the reverse bias can be further enhanced.

In this example embodiment, the above effects are added to the effects of the fifteenth embodiment. Specifically, magnetic flux generated by the primary coil 21 is capable of efficiently passing through the magnetic circuit including the side plate 61 and the upper plate 62, so that leakage of magnetic flux is significantly reduced. Thus, output power and performance of the ignition coil 1 can be further enhanced in the structure.

Eighteenth Embodiment

Figure 34:
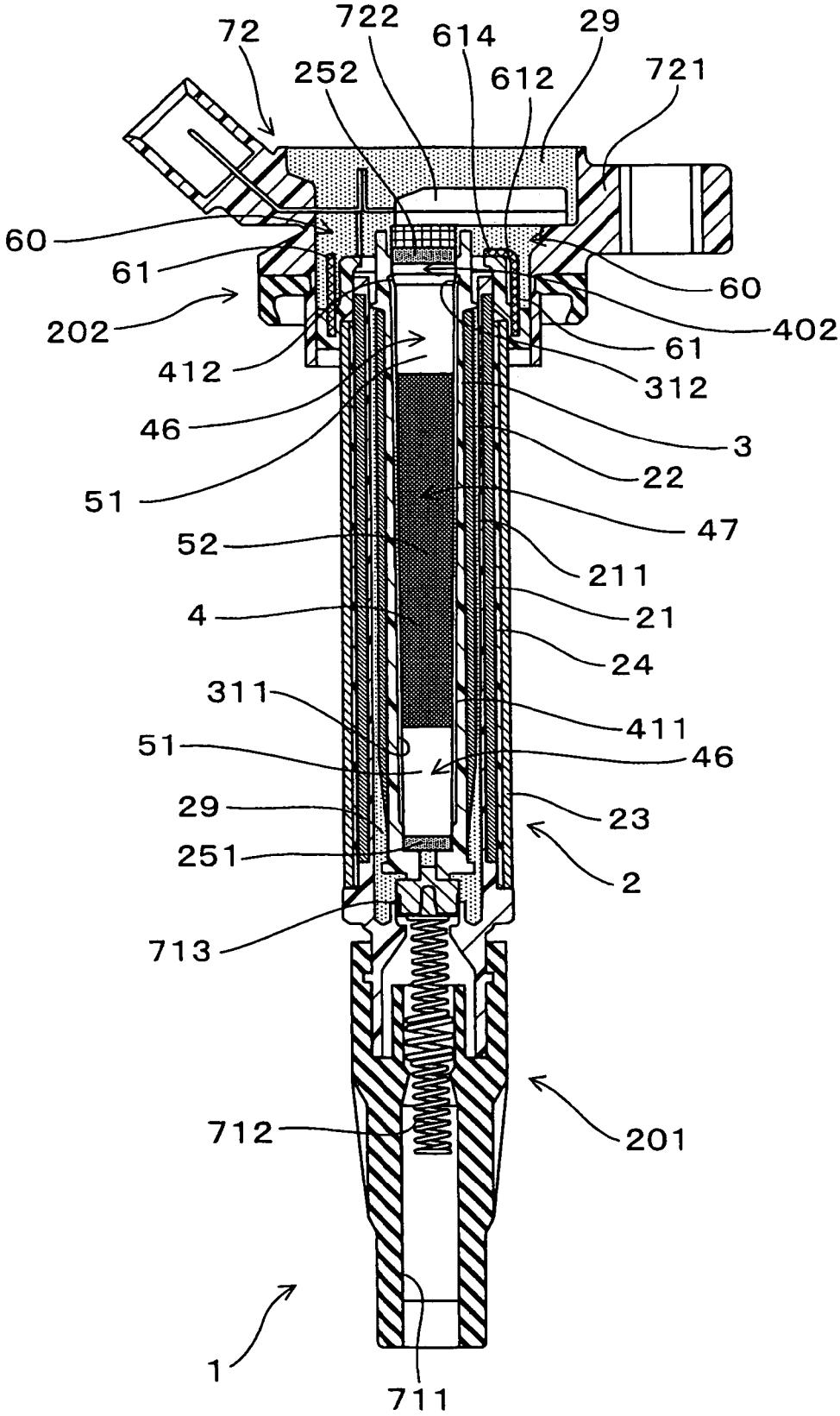
FIG. 34 is a partially cross sectional side view showing an ignition coil, according to an eighteenth embodiment of the present invention.
Figure 35:
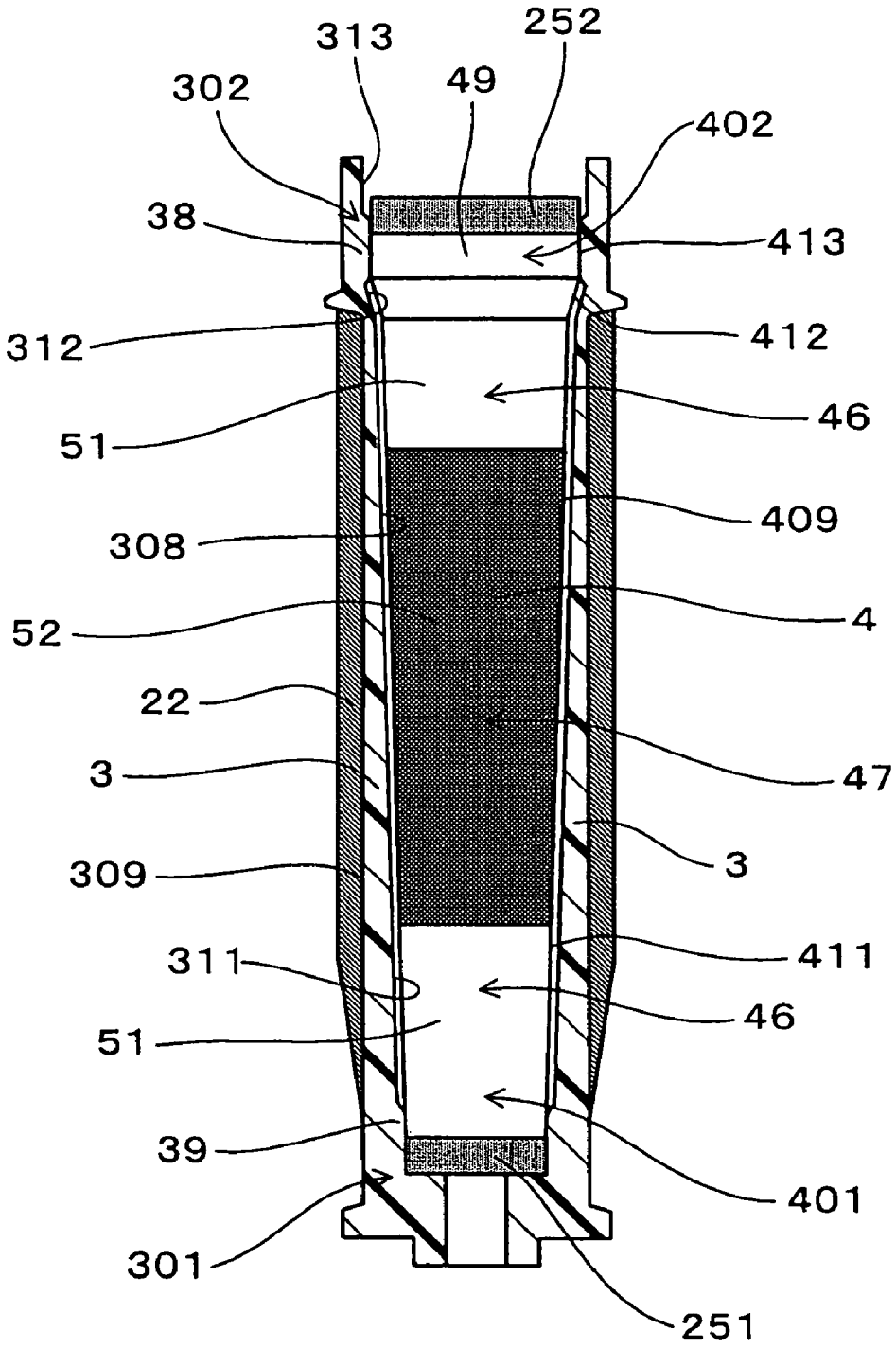
FIG. 35 is a partially cross sectional side view showing a secondary spool and a center core of the ignition coil, according to the eighteenth embodiment.
Figure 36:
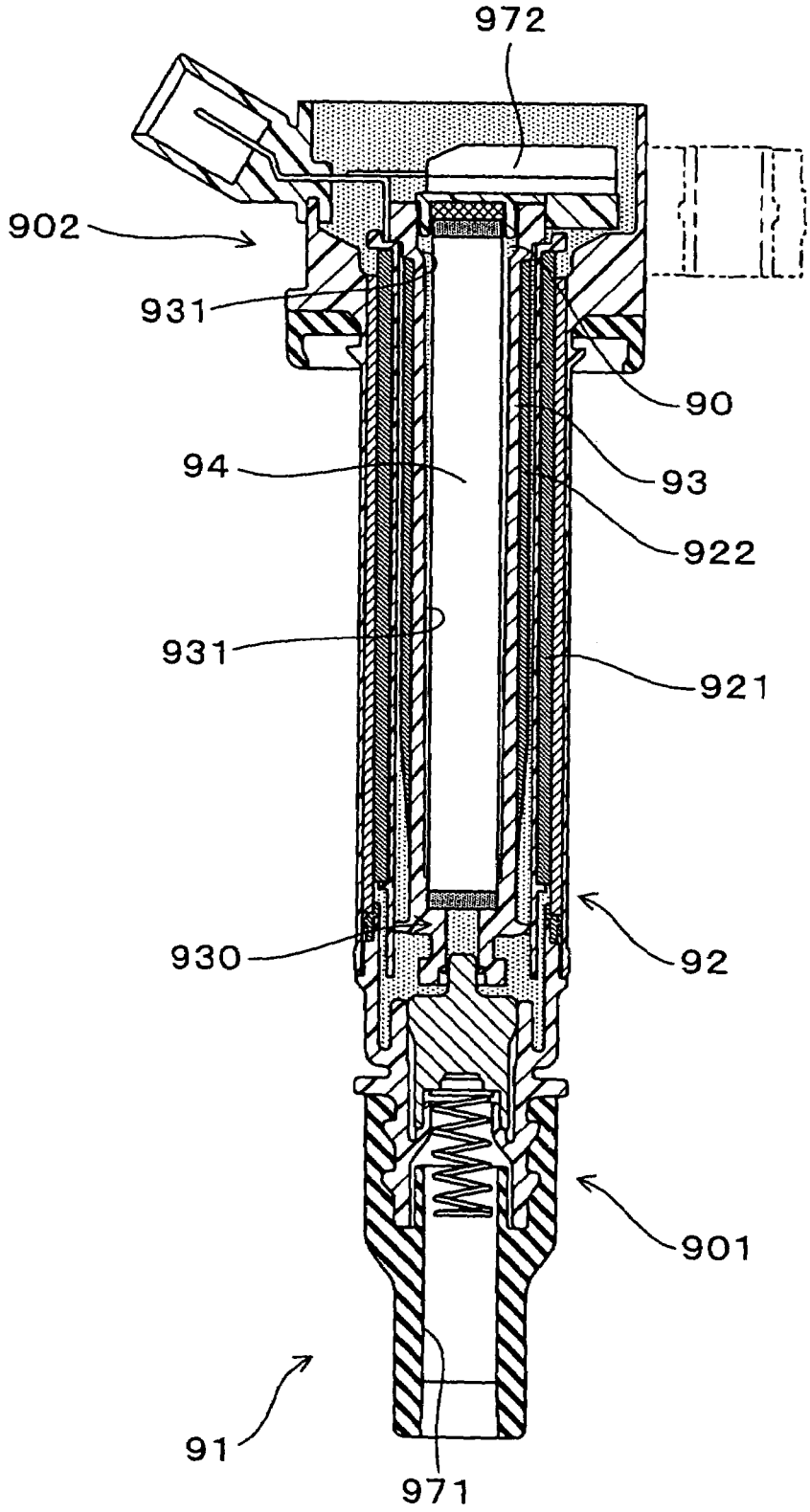
FIG. 36 PRIOR ART
FIG. 36 is a partially cross sectional side view showing an ignition coil, according to a prior art.
Figure 37:
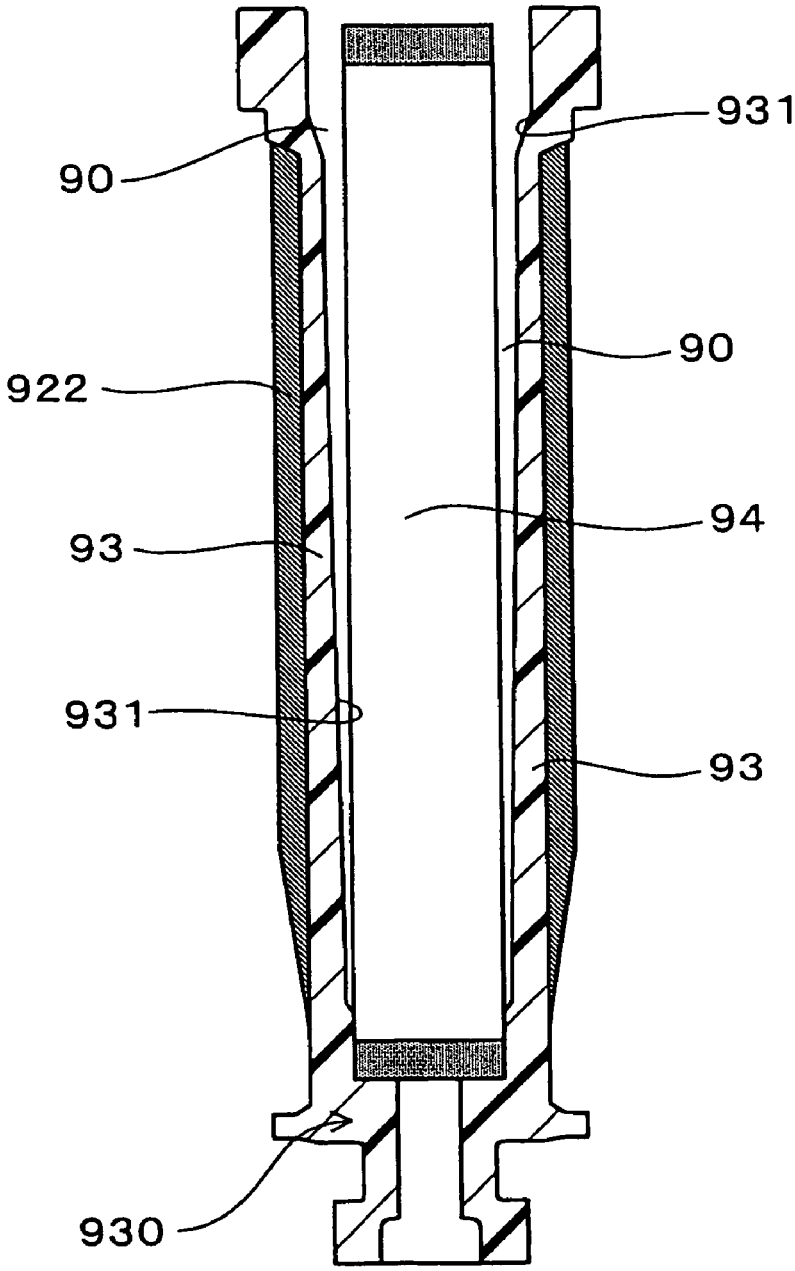
FIG. 37 PRIOR ART
FIG. 37 is a partially cross sectional side view showing a secondary spool and a center core of the ignition coil, according to the prior art.

As shown in FIGS. 34, 35, in this example embodiment, the shapes of the secondary spool 3, the center core 4, and the side plate 61 are modified compared with the ignition coil 1 of the fifth embodiment. In addition, the upper plate 62 is omitted from the ignition coil 1 of the fifth embodiment.

Referring to FIG. 35, the secondary spool 3 has the first and second tapered inner surfaces 311, 312. Each of the first and second tapered inner surfaces 311, 312 has the diameter that increases as being distant from the tip end 301 of the secondary spool 3. The secondary spool 3 further has the straight inner surface 313, which has the inner diameter substantially constant with respect to the axial direction thereof. The first tapered inner surface 311, the second tapered inner surface 312, and the straight inner surface 313 are arranged in this order from the side of the tip end 301 of the secondary spool 3.

The center core 4 has the first and second tapered outer surfaces 411, 412. Each of the first and second tapered outer surfaces 411, 412 has the diameter that increases as being distant from the tip end 401 of the center core 4. The center core 4 further has the straight outer surface 413, which has the outer diameter substantially constant with respect to the axial direction thereof. The first tapered outer surface 411, the second tapered outer surface 412, and the straight outer surface 413 are arranged in this order from the side of the tip end 401 of the center core 4.

The center core 4 has the outer circumferential surface 409, which is defined substantially along the inner circumferential surface 308 of the secondary spool 3. That is, the inner circumferential surfaces of the secondary spool 3 and the outer circumferential surfaces of the center core 4 substantially oppose each other. Specifically, the first tapered inner surface 311 and the first tapered outer surface 411 substantially oppose each other. The second tapered inner surface 312 and the second tapered outer surface 412, and the straight inner surface 313 and the straight outer surface 413 substantially oppose each other.

Referring to FIGS. 34, 35, the first and second soft magnetic materials 51, 52 forming the center core 4, and the construction of the center core 4 in this example embodiment are substantially similar to the structures in the seventeenth embodiment, in general.

Referring to FIG. 34, the side plate 61 has the bent end 614, which is bent from a part of the axial rear end 612 of the side plate 61 to the inside, similarly to the sixteenth embodiment. The bent end 614 has the inner circumferential end, which is opposed to the side surface of the permanent magnet 252 provided to the rear end 402 of the center core 4.

Referring to FIG. 34, structures of the ignition coil 1 other than the above construction in this example embodiment are substantially similar to the structures in the seventeenth embodiment, in general.

In the structure of this example embodiment, the bent end 614 of the side plate 61 has a function similar to that of the upper plate 62 in the fifteenth embodiment. That is, leakage of magnetic flux becomes small in the rear end 202 of the cylindrical portion 2, similarly to the structure, in which the upper plate 62 is provided, so that magnetic flux passing through the magnetic circuit can be efficiently enhanced.

In this example embodiment, the tapered outer surfaces 411, 412 of the center core 4 are arranged in the conventional redundant gap between the tapered inner surfaces 311, 312 of the secondary spool 3 and the center core 4. Therefore, the cross sectional area of the center core 4 increases in this portion corresponding to the conventional gap, so that the amount of magnetic flux passing through the center core 4 can be increased, without changing the outer dimension of the ignition coil 1, in general.

Structures of the ignition coil 1 other than the above construction in this example embodiment are substantially similar to the structures in the seventeenth embodiment, in general. Consequently, output power and performance of the ignition coil 1 can be further enhanced.

When the permanent magnet 252 is omitted from the ignition coil 1, the inner circumferential end of the bent end 614 is opposed to the side surface of the center core 4.

The inner circumferential end of the bent end 614 is distant from the side surface of the permanent magnet 252 for a distance equal to or greater than 1.0 mm. Alternatively, when the permanent magnet 252 is omitted from the ignition coil 1, the inner circumferential end of the bent end 614 is distant from the side surface of the center core 4 for a distance equal to or greater than 1.0 mm. In these structures, the center core 4 can be electrically insulated sufficiently with respect to the side plate 61.

The inner circumferential end of the bent end 614 is distant from the side surface of either the permanent magnet 252 or the center core 4 for a distance equal to or less than 3.0 mm. Further preferably, this distance is equal to or less than 2.0 mm. When this distance is within the range between 1.0 mm and 3.0 mm, or the range between 1.0 mm and 2.0 mm, magnetic flux is capable of sufficiently passing between the center core 4 and the side plate 61, and is capable of being restricted from leaking between the center core 4 and the side plate 61.

The above structures of the embodiments can be combined as appropriate.

The structure of the ignition coil 1Z in the eighth embodiment can be applied to the structures in the above second to eighteenth embodiments.

Various modifications and alternations may be diversely made to the above embodiments without departing from the spirit of the present invention.

What is claimed is:

1. An ignition coil comprising:

a primary coil;

a secondary coil that is arranged substantially coaxially with respect to the primary coil;

a spool that has a substantially cylindrical shape, one of the primary coil and the secondary coil being an inner coil arranged on an inner side of an other of the primary coil and the secondary coil, the inner coil being wound around the spool; and a center core that is located on an inner side of the spool, wherein the spool has a tapered inner surface, which is defined at least partially in the spool with respect to an axial direction of the spool, the tapered inner surface has a diameter that increases as being distant from a high voltage tip end of the secondary coil, the high voltage tip end of the secondary coil being on a high voltage side of the secondary coil, the center core has a tapered outer surface, which is defined at least partially in the center core with respect to an axial direction of the center core, the tapered outer surface has a diameter that increases as being distant from the high voltage tip end of the secondary coil, the tapered inner surface of the spool is opposed to the tapered outer surface of the center core with respect to a substantially radial direction of the center core, wherein the secondary coil has a low voltage tip end on a low voltage side of the secondary coil, and the low voltage tip end of the center core has a large diameter portion, which has an outer diameter largest of the center core, the low voltage tip end of the spool has a first contact inner surface that is adapted to making contact with the large diameter portion of the center core, so that the center axis of the center core is adjustable, and the high voltage tip end of the spool has a second contact inner surface that is adapted to making contact with a high voltage tip end of the center core, so that the center axis of the center core is adjustable.

2. The ignition coil according to claim 1, wherein the inner coil is wound on the spool in a winding region of the spool, and the large diameter portion of the center core is located on the low voltage side with respect to the winding region.

3. The ignition coil according to claim 1, further comprising:

a plurality of permanent magnets, one of the plurality of permanent magnets being arranged on one axial end of the center core, an other of the plurality of permanent magnets being arranged on an other axial end of the center core.

4. The ignition coil according to claim 1, wherein the center core is formed of a dust core.

5. The ignition coil according to claim 1, wherein the first contact inner surface is defined with a plurality of first protrusions protruding from a plurality of locations in an inner circumferential surface of the spool, the plurality of first protrusions is arranged in the plurality of locations with respect to a circumferential direction of the inner circumferential surface of the spool, the second contact inner surface is defined with a plurality of second protrusions protruding from a plurality of locations in the inner circumferential surface of the spool, and the plurality of second protrusions is arranged in the plurality of locations with respect to the circumferential direction of the inner circumferential surface of the spool.

6. The ignition coil according to claim 1, wherein the tapered inner surface of the spool has a protrusion that makes contact with the tapered outer surface of the center core, so that a center axis of the center core is adjustable with respect to a center axis of the spool.

7. The ignition coil according to claim 1, wherein the spool is a secondary spool, around which the secondary coil is wound, and the inner coil is the secondary coil.

8. The ignition coil according to claim 1, wherein the spool is a primary spool, around which the primary coil is wound, and the inner coil is the primary coil.

9. An ignition coil comprising:

a primary coil;

a secondary coil that is arranged substantially coaxially with respect to the primary coil;

a secondary spool that has a substantially cylindrical shape, the secondary coil being wound around the secondary spool; and a center core that is located on an inner side of the spool, wherein the secondary spool has a tapered inner surface, which is defined at least partially in the secondary spool with respect to an axial direction of the secondary spool, the tapered inner surface has a diameter that increases as being distant from a high voltage tip end of the secondary coil, the high voltage tip end of the secondary coil being on a high voltage side of the secondary coil, the center core has a tapered outer surface, which is defined at least partially in the center core with respect to an axial direction of the center core, the tapered outer surface has a diameter that increases as being distant from the high voltage tip end of the secondary coil, the tapered inner surface of the secondary spool is opposed to the tapered outer surface of the center core with respect to a substantially radial direction of the center core, wherein the secondary coil has a low voltage tip end on a low voltage side of the secondary coil, and the low voltage tip end of the center core has a large diameter portion, which has an outer diameter largest of the center core, the low voltage tip end of the spool has a first contact inner surface that is adapted to making contact with the large diameter portion of the center core, so that the center axis of the center core is adjustable, and the high voltage tip end of the spool has a second contact inner surface that is adapted to making contact with a high voltage tip end of the center core, so that the center axis of the center core is adjustable.

10. An ignition coil adapted to connecting with a sparkplug for generating spark in a combustion chamber of an internal combustion engine, the ignition coil comprising:

a primary coil;

a secondary coil that is arranged substantially coaxially with respect to the primary coil;

a spool that has a substantially cylindrical shape, one of the primary coil and the secondary coil being an inner coil arranged on an inner side of an other of the primary coil and the secondary coil, the inner coil being wound around the spool; and a center core that is arranged inside of the spool;

wherein the spool has a tapered inner surface, which is defined at least partially in the spool with respect to an axial direction of the spool, the tapered inner surface has a diameter that increases as being distant axially from the sparkplug, the center core has a tapered outer surface, which is defined at least partially in the center core with respect to an axial direction of the center core, the tapered outer surface has a diameter that increases as being distant axially from the sparkplug, the tapered inner surface of the spool is opposed to the tapered outer surface of the center core with respect to a substantially radial direction of the center core, wherein the secondary coil has a low voltage tip end on a low voltage side of the secondary coil, and the low voltage tip end of the center core has a large diameter portion, which has an outer diameter largest of the center core, the low voltage tip end of the spool has a first contact inner surface that is adapted to making contact with the large diameter portion of the center core, so that the center axis of the center core is adjustable, and the high voltage tip end of the spool has a second contact inner surface that is adapted to making contact with a high voltage tip end of the center core, so that the center axis of the center core is adjustable.

11. An ignition coil that is adapted to connecting with a sparkplug, the ignition coil comprising:

a cylindrical portion that includes a primary coil, a secondary coil, and a center core, the primary coil and the secondary coil being substantially coaxial with respect to each other; and a plug holder that is provided to a tip end of the cylindrical portion, the plug holder being adapted to connecting with the sparkplug, wherein the center core includes a first end portion, a second end portion, and a center portion, the first end portion is located on a side of one end of the center core with respect to an axial direction of the center core, the second end portion is located on a side of an other end of the center core with respect to the axial direction of the center core, the first end portion occupies 15% or greater in length of the center core, the second end portion occupies 15% or greater in length of the center core, the center portion is located between the first end portion and the second end portion, the first end portion and the second end portion of the center core are formed of a first soft magnetic material, the center portion of the center core is at least partially formed of a second soft magnetic material, and the second soft magnetic material has a saturation magnetic flux density, which is higher than a saturation magnetic flux density of the first soft magnetic material.

12. The ignition coil according to claim 11, wherein the saturation magnetic flux density of the second soft magnetic material is equal to or greater than 2.0 T.

13. The ignition coil according to claim 11, wherein the second soft magnetic material is Permendur.

14. The ignition coil according to claim 11, wherein the center portion is entirely formed of the second soft magnetic material.

15. The ignition coil according to claim 11, wherein the center portion is divided into at least one first soft magnetic material portion and at least one second soft magnetic material portion with respect to an axial direction of the center portion, the at least one first soft magnetic material portion is formed of the first soft magnetic material, the at least one second soft magnetic material portion is formed of the second soft magnetic material, and the at least one first soft magnetic material portion and the at least one second soft magnetic material portion are alternatively arranged with respect to the axial direction of the center portion.

16. The ignition coil according to claim 11, wherein the center portion is divided into a plurality of portions with respect to a radial direction of the center portion, and the plurality of portions is at least partially formed of the second soft magnetic material.

17. The ignition coil according to claim 11, wherein the center portion has a slant portion that is partitioned by a slant surface, which is slanted with respect to an axial direction of the center portion, and the slant portion is formed of the second soft magnetic material.

18. The ignition coil according to claim 11, wherein the center core is formed of a dust core.

19. An ignition coil that is adapted to be connecting with a sparkplug, the ignition coil comprising:

a cylindrical portion that includes a primary coil, a secondary coil, a center core, and an outer core, the primary coil being substantially coaxial with respect to the secondary coil, the center core being arranged on an inner circumferential side of the secondary coil, the outer core being arranged on an outer circumferential side of the primary coil; and a plug holder that is provided to a tip end of the cylindrical portion, the plug holder being adapted to connecting with the sparkplug, wherein the cylindrical portion includes a rear end portion, and the center core has a rear end, which at least partially protrude to a rear side axially beyond the outer core in a non-lapping region of the rear end portion of the cylindrical portion, the ignition coil further comprising:

a side plate that at least partially covers the non-lapping region from an outer circumferential side, wherein the side plate is formed of a soft magnetic material.

20. The ignition coil according to claim 19, further comprising:

an upper plate that is provided in the rear end portion of the cylindrical portion, wherein the side plate has an axial rear end on an axially rear side of the side plate, the upper plate at least partially is opposed to both the axial rear end of the side plate and the rear end of the center core, and the upper plate that is formed of a soft magnetic material.

21. The ignition coil according to claim 19, wherein the axial rear end of the side plate includes a bent end that is bent to an inside of the side plate.

22. The ignition coil according to claim 21, wherein the bent end of the side plate has an inner circumferential end that is opposed to a side surface of the center core.

23. The ignition coil according to claim 22, wherein the inner circumferential end of the bent end of the side plate is distant from the side surface of the center core for a distance, which is equal to or greater than 1 mm.

24. The ignition coil according to claim 23, wherein the inner circumferential end of the bent end of the side plate is distant from the side surface of the center core for the distance, which is equal to or less than 3 mm.

25. The ignition coil according to claim 19, further comprising:

a plurality of permanent magnets, one of the plurality of permanent magnets being arranged on one axial end of the center core, an other of the plurality of permanent magnets being arranged on an other axial end of the center core.

26. The ignition coil according to claim 19, further comprising:

a fixing resinous member that at least partially covers the side plate, wherein the fixing resinous member is formed of resin, the side plate is integrated with the fixing resinous member, and the side plate is fixed by engaging the fixing resinous member with the outer core.

27. The ignition coil according to claim 19, further comprising:

a fixing resinous member that at least partially covers the side plate, wherein the fixing resinous member is formed of resin, the side plate is press-inserted into the fixing resinous member, and the side plate is fixed by engaging the fixing resinous member with the outer core.

28. An ignition coil adapted to connecting with a sparkplug, the ignition coil comprising:

a cylindrical portion that includes a primary coil, a secondary coil, a spool, and a center core, the primary coil and the secondary coil being substantially coaxial with respect to each other, one of the primary coil and the secondary coil being an inner coil arranged on an inner side of an other of the primary coil and the secondary coil, the inner coil being wound around the spool having a substantially cylindrical shape, the center core being on an inner circumferential side of the spool; and a plug holder that is provided to a tip end of the cylindrical portion, the plug holder being adapted to connecting with the sparkplug;

wherein the spool has a tapered inner surface, which is defined at least partially in the spool with respect to an axial direction of the spool, the tapered inner surface has a diameter that increases as being distant axially from the plug holder, the center core has a tapered outer surface, which is defined at least partially in the center core with respect to an axial direction of the center core, the tapered outer surface has a diameter that increases as being distant axially from the plug holder, the tapered inner surface of the spool is opposed to the tapered outer surface of the center core with respect to a substantially radial direction of the center core, the center core includes a first end portion, a second end portion, and a center portion, the first end portion is located on a side of one end of the center core with respect to an axial direction of the center core, the second end portion is located on an axially opposite side of the first end portion with respect to the center portion, the first end portion occupies 15% or greater in length of the center core, the second end portion occupies 15% or greater in length of the center core, the first end portion and the second end portion of the center core are formed of a first soft magnetic material, the center portion of the center core is at least partially formed of a second soft magnetic material, and the second soft magnetic material has a saturation magnetic flux density, which is higher than a saturation magnetic flux density of the first soft magnetic material.

29. An ignition coil adapted to connecting with a sparkplug, the ignition coil comprising:

a cylindrical portion that includes a primary coil, a secondary coil, a spool, a center core, and an outer core, the primary coil being substantially coaxial with respect to the secondary coil being wound around the spool having a substantially cylindrical shape, the center core being arranged on an inner circumferential side of the spool, the outer core being arranged on an outer circumferential side of the primary coil; and a plug holder that is provided to a tip end of the cylindrical portion, the plug holder being adapted to connecting with the sparkplug, wherein the spool has a tapered inner surface, which is defined at least partially in the spool with respect to an axial direction of the spool, the tapered inner surface has a diameter that increases as being distant axially from the sparkplug, the center core has a tapered outer surface, which is defined at least partially in the center core with respect to an axial direction of the center core, the tapered outer surface has a diameter that increases as being distant axially from the sparkplug, the tapered inner surface of the spool is opposed to the tapered outer surface of the center core with respect to a substantially radial direction of the center core, the cylindrical portion includes a rear end portion on an axially opposite side of the plug holder, and the center core has a rear end, which at least partially protrude to the axially opposite side of the plug holder axially beyond the outer core in a non-lapping region of the rear end portion of the cylindrical portion, the ignition coil further comprising:

a side plate that at least partially covers the non-lapping region from an outer circumferential side, wherein the side plate is formed of a soft magnetic material.

30. An ignition coil that is adapted to connecting with a sparkplug, the ignition coil comprising:

a cylindrical portion that includes a primary coil, a secondary coil, a center core, and an outer core, the primary coil being substantially coaxial with respect to the secondary coil, the center core being arranged on an inner circumferential side of the secondary coil, the outer core being arranged on an outer circumferential side of the primary coil; and a plug holder that is provided to a tip end of the cylindrical portion, the plug holder being adapted to connecting with the sparkplug, wherein the center core includes a first end portion, a second end portion, and a center portion, the first end portion is located on an axially opposite side of the second end portion with respect to the center portion, the first end portion occupies 15% or greater in length of the center core, the second end portion occupies 15% or greater in length of the center core, the first end portion and the second end portion of the center core are formed of a first soft magnetic material, the center portion of the center core is at least partially formed of a second soft magnetic material, the second soft magnetic material has a saturation magnetic flux density, which is higher than a saturation magnetic flux density of the first soft magnetic material, the cylindrical portion includes a rear end portion on an axially opposite side of the plug holder, and the center core has a rear end, which is at least partially protrude to an axially opposite side of the plug holder axially beyond the outer core in a non-lapping region of the rear end portion of the cylindrical portion, the ignition coil further comprising:

a side plate that at least partially covers the non-lapping region from an outer circumferential side, wherein the side plate is formed of a soft magnetic material.

31. An ignition coil comprising:

a primary coil;

a secondary coil that is arranged substantially coaxially with respect to the primary coil;

a spool that has a substantially cylindrical shape, one of the primary coil and the secondary coil being an inner coil arranged on an inner side of an other of the primary coil and the secondary coil, the inner coil being wound around the spool; and a center core that is located on an inner side of the spool, wherein the spool has a tapered inner surface, which is defined at least partially in the spool with respect to an axial direction of the spool, the spool has a straight outer surface that extends substantially straight, in parallel with a center axis of the spool, the tapered inner surface has a diameter that increases in a direction away from a high voltage tip end of the secondary coil, the high voltage tip end of the secondary coil being on a high voltage side of the secondary coil, the center core has a tapered outer surface, which is defined at least partially in the center core with respect to an axial direction of the center core, the tapered outer surface has a diameter that increases in a direction away from the high voltage tip end of the secondary coil, and the tapered inner surface of the spool is opposed to the tapered outer surface of the center core with respect to a substantially radial direction of the center core.

* * * * *